US007526238B2

(12) United States Patent
Yamada et al.

(10) Patent No.: US 7,526,238 B2
(45) Date of Patent: Apr. 28, 2009

(54) DEVELOPING DEVICE, PROCESS CARTRIDGE AND IMAGE FORMING APPARATUS MOVING TONER PARTICLES BY A PHASE-SHIFTING ELECTRIC FIELD

(75) Inventors: Masaaki Yamada, Tokyo (JP); Masanori Horike, Yokohama (JP); Yohichiroh Miyaguchi, Yokohama (JP); Nobuaki Kondoh, Yokohama (JP); Yoshinori Nakagawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/370,057

(22) Filed: Mar. 8, 2006

(65) Prior Publication Data

US 2006/0216071 A1 Sep. 28, 2006

(30) Foreign Application Priority Data

Mar. 16, 2005 (JP) ..... 2005-074172
Jul. 25, 2005 (JP) ..... 2005-214828

(51) Int. Cl.
*G03G 15/08* (2006.01)

(52) U.S. Cl. ..... 399/279; 399/283

(58) Field of Classification Search ..... 399/283, 399/281, 279

See application file for complete search history.

(56) References Cited

U.S. PATENT DOCUMENTS 4,994,859 A * 2/1991 Mizuno et al. ..... 399/266
5,809,385 A * 9/1998 Snelling et al. ..... 399/266
5,899,608 A * 5/1999 Eklund et al. ..... 399/266
5,968,301 A 10/1999 Murakami et al.
6,104,904 A * 8/2000 Snelling ..... 399/265
6,597,884 B2 7/2003 Miyaguchi et al.
6,708,014 B2 3/2004 Miyaguchi et al.
6,816,694 B2 * 11/2004 Adachi et al. ..... 399/265

(Continued)

FOREIGN PATENT DOCUMENTS

JP 3530124 3/2004

(Continued)

OTHER PUBLICATIONS

U.S. Appl. No. 11/681,940, filed Mar. 5, 2007, Takahashi et al.

(Continued)

*Primary Examiner*—Quana M Grainger
(74) *Attorney, Agent, or Firm*—Oblon, Spivak, McClelland, Maier & Neustadt, P.C.

(57) ABSTRACT

Development device includes an electrostatic conveyance device, a supply device, and a collection device. The electrostatic conveyance device moves toner on a surface thereof in a toner conveyance direction by a phase-shifting electric field. The surface has upstream and downstream side ends where the phase-shifting electric field starts and ends, respectively. The supply device opposes the upstream side end to supply the toner onto the electrostatic conveyance surface. The toner supplied by the supply device onto the electrostatic conveyance surface is moved by the phase-shifting electric field to a development area of the electrostatic conveyance device opposing an image bearing. The collection device opposes the downstream side end and collects the toner moved on the electrostatic conveyance surface to a downstream side of the development area of the electrostatic conveyance device in the toner conveyance direction without contributing to the development.

16 Claims, 22 Drawing Sheets

U.S. PATENT DOCUMENTS

| | | | | |
|---|---|---|---|---|
| 6,901,231 | B1 | 5/2005 | Sakai et al. | |
| 6,931,223 | B2 | 8/2005 | Yamada | |
| 6,941,098 | B2 | 9/2005 | Miyaguchi et al. | |
| 6,947,691 | B2 | 9/2005 | Miyaguchi et al. | |
| 7,099,611 | B2 * | 8/2006 | Aoki et al. | 399/281 |
| 2004/0105710 | A1 | 6/2004 | Shakuto et al. | |
| 2004/0126148 | A1 | 7/2004 | Iwai et al. | |
| 2004/0131394 | A1 * | 7/2004 | Katoh et al. | 399/281 |
| 2004/0197122 | A1 | 10/2004 | Nakano et al. | |
| 2004/0240907 | A1 | 12/2004 | Miyaguchi et al. | |
| 2004/0265024 | A1 | 12/2004 | Naruse et al. | |
| 2005/0002054 | A1 | 1/2005 | Shoji et al. | |
| 2005/0025525 | A1 | 2/2005 | Horike et al. | |
| 2005/0047805 | A1 * | 3/2005 | Okubo | 399/27 |
| 2005/0100374 | A1 | 5/2005 | Satoh et al. | |
| 2005/0152717 | A1 * | 7/2005 | Miyaguchi et al. | 399/252 |
| 2005/0154562 | A1 | 7/2005 | Matsuura et al. | |
| 2005/0157327 | A1 | 7/2005 | Shoji et al. | |
| 2005/0158073 | A1 | 7/2005 | Nakazato et al. | |
| 2005/0169660 | A1 | 8/2005 | Yamada et al. | |
| 2006/0216071 | A1 | 9/2006 | Yamada et al. | |
| 2007/0242985 | A1 * | 10/2007 | Aoki et al. | 399/274 |
| 2008/0089723 | A1 * | 4/2008 | Tsukamoto et al. | 399/281 |

FOREIGN PATENT DOCUMENTS

| | | |
|---|---|---|
| JP | 2004-198675 | 7/2004 |

OTHER PUBLICATIONS

U.S. Appl. No. 11/546,251, filed Oct. 12, 2006, Tsukamoto et al.
U.S. Appl. No. 12/176,054, filed Jul. 18, 2008, Kadota et al.
U.S. Appl. No. 12/121,122, filed May 15, 2008, Kadota et al.
U.S. Appl. No. 12/140,032, filed Jun. 16, 2008, Ishii et al.
U.S. Appl. No. 12/170,930, filed Jul. 10, 2008, Takahashi et al.

* cited by examiner

DEVELOPING DEVICE, PROCESS CARTRIDGE AND IMAGE FORMING APPARATUS MOVING TONER PARTICLES BY A PHASE-SHIFTING ELECTRIC FIELD

CROSS-REFERECE TO RELATED APPLICATIONS

The present application claims priority and contains subject matter related to Japanese Patent Applications No. 2005-074172 and NO. 2005-214828 filed in the Japanese Patent Office on Mar. 16, 2005 and Jul. 25, 2005, respectively, and the entire contents of which are hereby incorporated herein by reference.

BACKGROUND OF THE INVENTION

1. Field of the Invention

The present invention relates to a development device moving toner particles by a phase-shifting electric field, and a process cartridge and an image forming apparatus using the development device.

2. Discussion of the Background

An image forming apparatus of electrophotography has been known as a printer, a copier, a facsimile apparatus, a plotter, and a multi-function apparatus having the functions of a printer, a facsimile apparatus and a copier. The image forming apparatus forms an image on a recording medium by charging an image bearing member, forming a latent image on the charged image bearing member, developing the latent image into a toner image by causing toner particles as powder to be adhered to the latent image, and transferring the toner image onto the recording medium.

A known development device of such an electrophotographic image forming apparatus causes the toner particles to move in the horizontal and vertical directions on the surface of an electrostatic conveyance member by giving energy of a phase-shifting electric field to the toner particles. The toner particles are moved on the surface of the electrostatic conveyance member to a development area where the image bearing member and the electrostatic conveyance member oppose each other by the phase-shifting electric field and are caused to adhere to the latent image on the image bearing member in the development area. For example, Japanese Patent Publication No. 3530124 and Japanese Patent Laid-open publication No. 2004-198675 describe such a development device.

In a development device in which toner particles are moved by the phase-shifting electric field on the surface of an electrostatic conveyance member, to achieve uniform development, the toner particles must be supplied and moved uniformly throughout the whole development area of the electrostatic conveyance surface of the electrostatic conveyance member. Accordingly, it is important that the toner particles are uniformly supplied onto the electrostatic conveyance surface of the electrostatic conveyance member and the supplied toner particles are uniformly moved on the surface of the electrostatic conveyance surface of the electrostatic conveyance member.

However, when the electrostatic conveyance surface of the electrostatic conveyance member is formed in a circular shape, such as an endless loop and a roller, if the toner particles on the electrostatic conveyance surface pass the development area without contributing to development and return to a supply area of the electrostatic conveyance surface where toner particles are supplied from a toner supply device, even when the toner particles are uniformly supplied onto the electrostatic conveyance surface of the electrostatic conveyance member by the toner supply device, the quantity of toner particles moving on the electrostatic conveyance surface is not uniform, so that uneven development is caused.

In the development device described in JP No. 3530124, a collection member to collect the toner particles on the surface of an electrostatic conveyance member that have passed the development area of the electrostatic conveyance member is provided. However, the phase-shifting electric field causing the toner particles on the surface of the electrostatic conveyance member to move in the toner particle moving direction is generated in a collection area of the electrostatic conveyance member where the collection member is arranged, so that the toner particles that have not been collected when passing the collection area are moved by the phase-shifting electric field to reach the supply area of the electrostatic conveyance member where the toner particles are supplied, and thereby unevenness is caused in the quantity of the toner particles moving on the electrostatic conveyance surface of the electrostatic conveyance member.

Further, in an electrostatic conveyance member formed in a flat plate, if the toner particles on the electrostatic conveyance surface thereof that have passed the development area of the electrostatic conveyance member are not reliably collected, the toner particles stagnate at the downstream end part of the electrostatic conveyance member in the toner conveying direction, and it is likely that faulty movement of the toner particles is caused on the electrostatic conveyance surface of the electrostatic conveyance member.

SUMMARY OF THE INVENTION

The present invention has been made in views of the above-discussed and other problems and addresses the above-discussed and other problems.

The present invention provides a novel development device which is capable of stably supplying and collecting toner. In one example, a novel development device includes an electrostatic conveyance device, a supply device, and a collection device. The electrostatic conveyance device has an electrostatic conveyance surface and is configured to move toner particles on the electrostatic conveyance surface in a toner conveyance direction by a phase-shifting electric field. The electrostatic conveyance surface has an upstream side end where the phase-shifting electric field starts and a downstream side end where the phase-shifting electric field ends. The supply device is arranged to oppose the upstream side end of the electrostatic conveyance surface of the electrostatic conveyance device to supply the toner particles onto the electrostatic conveyance surface of the electrostatic conveyance device. The toner particles supplied by the supply device onto the electrostatic conveyance surface of the electrostatic conveyance device is moved on the electrostatic conveyance surface by the phase-shifting electric field to a development area of the electrostatic conveyance device opposing the image bearing member for development of the latent image on the latent image bearing member. The collection device is arranged to oppose the downstream side end of the electrostatic conveyance surface of the electrostatic conveyance device and is configured to collect the toner particles moved on the electrostatic conveyance surface to a downstream side of the development area of the electrostatic conveyance device in the toner conveyance direction without contributing to the development of the latent image in the development area.

The present invention further provides an image forming apparatus which is capable of stably supplying and collecting toner. In one example, a novel image forming apparatus includes a development device which develops a latent image on an image bearing member of an image forming apparatus and includes an electrostatic conveyance device, a supply device, and a collection device. The electrostatic conveyance device has an electrostatic conveyance surface and is configured to move powder on the electrostatic conveyance surface by a phase-shifting electric field to a development area of the electrostatic conveyance device opposing the image bearing member to develop the latent image on the image bearing member. The supply device is configured to supply the powder to the electrostatic conveyance device from a powder accommodation part accommodating the powder. The collection device is configured to collect the powder on the electrostatic conveyance surface of the electrostatic conveyance device passed the development area of the electrostatic conveyance device without contributing to development in the development area, and includes a collection member. The collection member is configured to collect the powder on the electrostatic conveyance surface of the electrostatic conveyance device passed the development area of the electrostatic conveyance member by applying bias voltage to the collection member before the powder passed the development area of the electrostatic conveyance device reaches the development area again.

BRIEF DESCRIPTION OF THE DRAWINGS

A more complete appreciation of the present invention and many of the attended advantages thereof will be readily obtained as the present invention becomes better understood by reference to the following detailed description when considered in connection with the accompanying drawings, wherein.

DETAILED DESCRIPTION OF THE PREFERRED EMBODIMENTS

Figure 1:
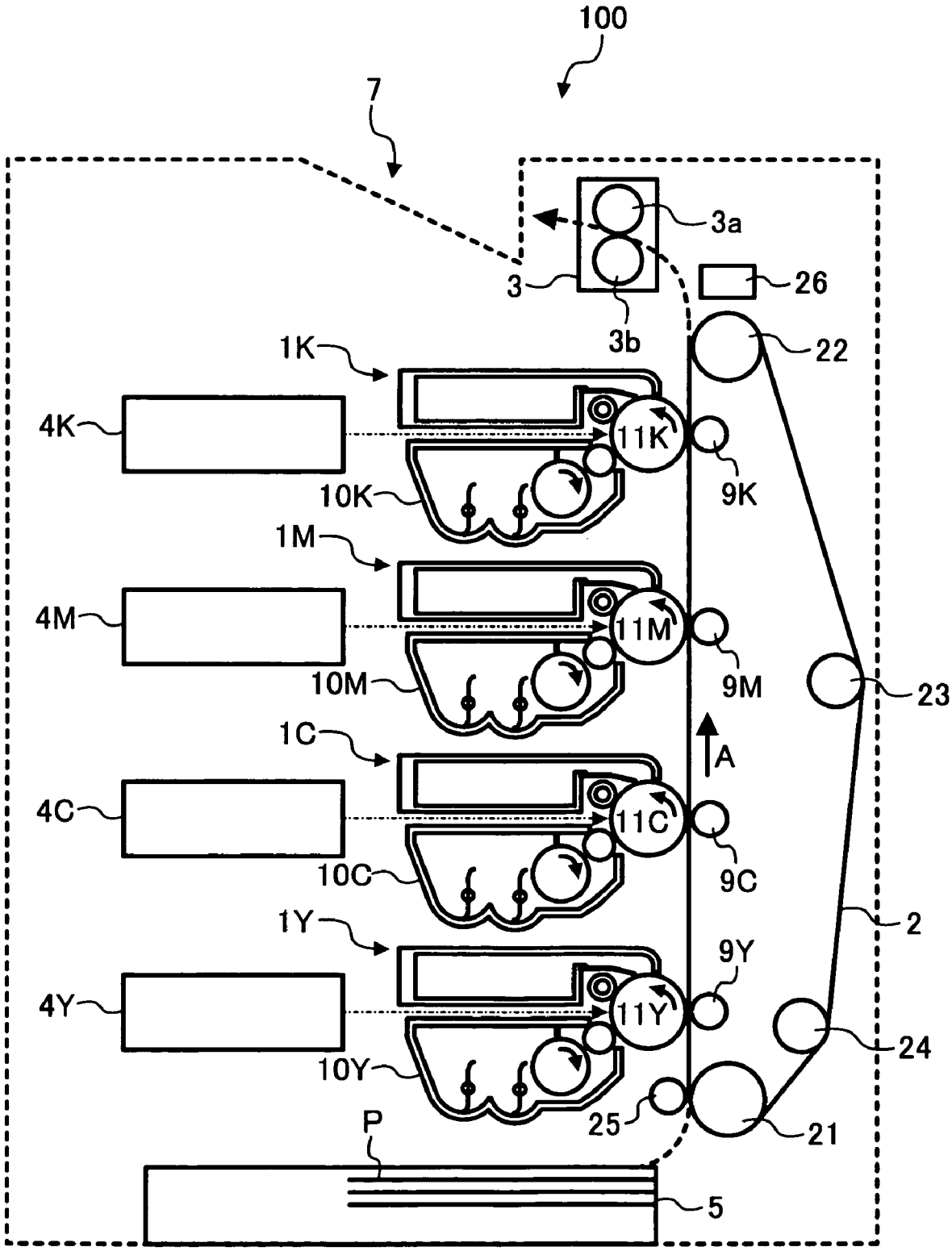
FIG. 1 is a diagram schematically illustrating a construction of a laser printer as an example of an electrophotographic image forming apparatus including a development device according to an embodiment of the present invention.

Referring now to the drawings, wherein like reference numerals designate identical or corresponding parts throughout the several views, preferred embodiments of the present invention are described.

FIG. 1 schematically illustrates a construction of a laser printer 100 as an example of an electrophotographic image forming apparatus including a development device according to an embodiment of the present invention (hereinafter simply referred to as the printer 100).

The printer 100 includes image formation units 1K, 1M, 1C, and 1Y forming toner image of black (K), magenta (M), cyan (C), and yellow (Y). The image formation units 1K, 1M, 1C, and 1Y include photoconductors 11K, 11M, 11C, and 11Y as image bearing members, charge devices for charging the image bearing members, development devices 10K, 10M, 10C, and 10Y of the present invention, and cleaning devices 14K, 14M, 14C, and 14Y for cleaning the image bearing members. The image formation units 1K, 1M, 1C, and 1Y are arranged vertically so as to be lined at the side of a spanned surface of a transfer member conveyance belt 2 as a recording medium conveyance member. Suffixes K, M, C, and Y added to reference numerals of respective elements of the image formation units correspond to colors of toners used in the image formation units. These suffixes are similarly added to reference numerals of respective members in the printer 100. Hereinafter, when differentiating the colors of toner is not necessary, the suffixes may be omitted.

Optical writing devices 4K, 4M, 4C, and 4Y are arranged at the left side of the image formation units 1K, 1M, 1C, and 1Y in figure. Transfer rollers 9K, 9M, 9C, and 9Y are provided to oppose the image formation units 1K, 1M, 1C, and 1Y while sandwiching the transfer member conveyance belt 2. Further, a sheet feed device 5 accommodating transfer sheets P as recording media is provided below the transfer member conveyance belt 2, and a fixing device 3 is provided above the transfer member conveyance belt 2.

The optical writing devices 4K, 4M, 4C, and 4Y optically write latent images according to image information on the surfaces of the photoconductors 11K, 11M, 11C, and 11Y of the image formation units 1K, 1M, 1C, and 1Y, that have been charged. Various types of optical writing devices, such as an optical scanning device using a polygon mirror, an LED array, etc., may be used.

The transfer member conveyance belt 2 is spanned around a conveyance roller 21, a driven roller 22, and tension rollers 23 and 24, and is moved in the direction of an arrow A by rotation of the conveyance roller 21. An adsorbing roller 25 is arranged to oppose the conveyance roller 21 to cause the transfer sheet P to be adsorbed on the transfer member conveyance belt 2, and a sensor 26 is arranged above the transfer member conveyance belt 2 at the side of the fixing device 3, which, when a toner pattern is formed on the transfer member conveyance belt 2, detects the toner pattern.

Each of the transfer rollers 9K, 9M, 9C, and 9Y has at least a core metal and a conductive elastic layer covering the core metal. The conductive elastic layer is formed of an elastic member adjusted to have the electric resistivity (volume resistivity) of $10^6$-$10^{10}$ Ωcm by compounding and dispersing in elastic material, such as polyurethane rubber, ethylene-propylene-dienepolyethylene (EPDM), etc., a conducting property imparting agent, such as carbon black, zinc oxide, zinc tin, etc.

The fixing device 3 includes a heating roller 3*a*, and a pressing roller 3*b* opposing the heating roller 3*a*.

In the image forming operation of the printer 100, the transfer sheet P, which is supplied from the sheet feed device 5, is adsorbed on the transfer member conveyance belt 2 by applying a predetermined voltage to the adsorbing roller 25. The transfer sheet P is moved together with the transfer member conveyance belt 2 in the state of being born on the transfer member conveyance belt 2, and toner images of respective colors are sequentially transferred onto the transfer sheet P from the image formation units 1K, 1M, 1C, and 1Y, and thereby a color toner image is formed on the transfer sheet P. The transfer sheet P then reaches the fixing device 3, where the toner image on the transfer sheet P is fixed to the transfer sheet P by being sandwiched and heated between the heating roller 3*a* and the pressing roller 3*b*, and thereby a visible color image is formed on the transfer sheet P. Thereafter, the transfer sheet P is exited to a sheet exit part 7 provided on the upper surface of the main body of the printer 100.

In the adjusting operation of the printer 100 in which color deviation among toner images of respective colors and toner density are adjusted, toner images of a predetermined pattern are directly formed on the transfer member conveyance belt 2 by the image formation units 1K, 1M, 1C, and 1Y, the toner images are detected by the sensor 26, and optical writing timings and development bias voltages are adjusted according to detection results so that an optimum color image is obtained. The toner images on the transfer member conveyance belt 2 are collected by the image formation units 1K, 1C, 1M, and 1Y due to voltages applied to the transfer rollers 9K, 9M, 9C, and 9Y after the charge polarities of the toner images on the transfer member conveyance belt 2 haven been adjusted by a bias voltage applied to the adsorbing roller 25.

Figure 2:
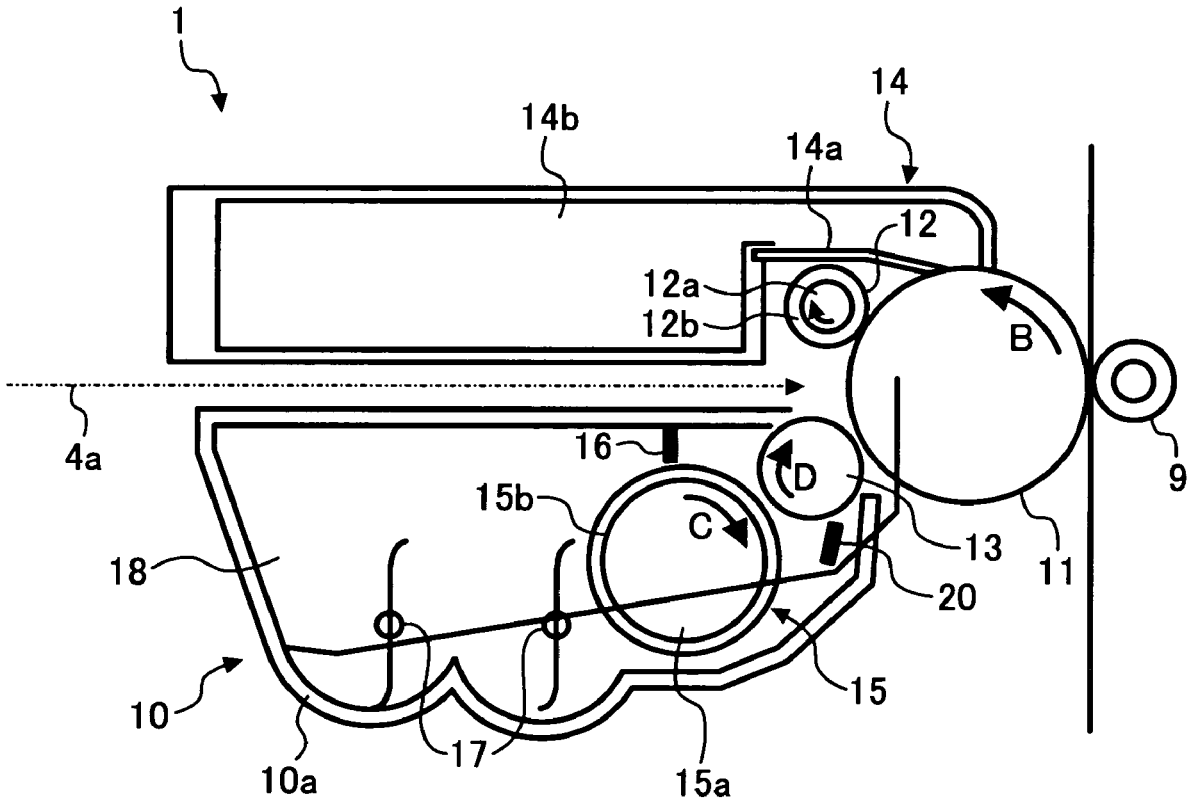
FIG. 2 is a diagram schematically illustrating a construction of an image formation unit including the development device of the printer.

FIG. 2 schematically illustrates a construction of one of the image formation units 1K, 1M, 1C, and 1Y. The image formation units 1K, 1M, 1C, and 1Y have substantially the same configuration except that the colors of used toner are different, so that the suffixes Y, M, C, and K are omitted. The image formation unit 1 includes the photoconductor 11, a charging roller 12 serving as the charge device, the development device 10, and the cleaning device 14.

The photoconductor 11 is an organic photoconductor to be negatively charged, and is rotated in the direction of an arrow B, that is, in the counterclockwise direction, in FIG. 2 by a rotation drive mechanism (not shown). The cleaning device 14 includes a cleaning blade 14*a* arranged, at an angle to counter the rotation direction of the photoconductor 11, to contact the surface of the photoconductor 11, and a discarded toner accommodation part 14*b* accommodating the toner scraped off the photoconductor 11 as discarded toner. The charging roller 12 is a flexile roller made by forming an urethane foam layer 12*b* of medium-resistance, in which urethane resin, carbon black as conductive particles, sulphidizing agent, foaming agent, etc., have been mixed, on a core metal 12*a* in a roller shape. The material for the medium-resistance layer of the charging roller 12 is not limited to the above-described one, and rubber materials, such as urethane, ethylene-propylene-dienepolyethylene (EPDM), butadiene-acrylonitrile rubber (NBR), silicone rubber, isoprene rubber, etc., in which conductive materials, such as carbon black, metal oxide, etc., are dispersed for resistance adjustment, and expanded ones of these rubber materials may be used.

The development device 10 includes an electrostatic conveyance roller 13 formed in a roller shape as an electrostatic conveyance device causing toner particles as powder to move by a phase-shifting (progressive wave) electric field for development of a latent image on the photoconductor 11, a developer accommodation part 18 accommodating developer, a supply roller 15 as a supply device to supply the toner particles onto the electrostatic conveyance roller 13, and a toner collection device 20 collecting the toner particles moving on the electrostatic conveyance roller 13.

The electrostatic conveyance roller 13 has a plurality of electrodes for generating a phase-shifting electric field for moving, applying for development, and collecting toner particles as powder, and is arranged to oppose the photoconductor 11. When forming an image, the electrostatic conveyance roller 13 is separated from the photoconductor 11, 50-1000 μm, preferably 150-400 μm.

Figure 3:
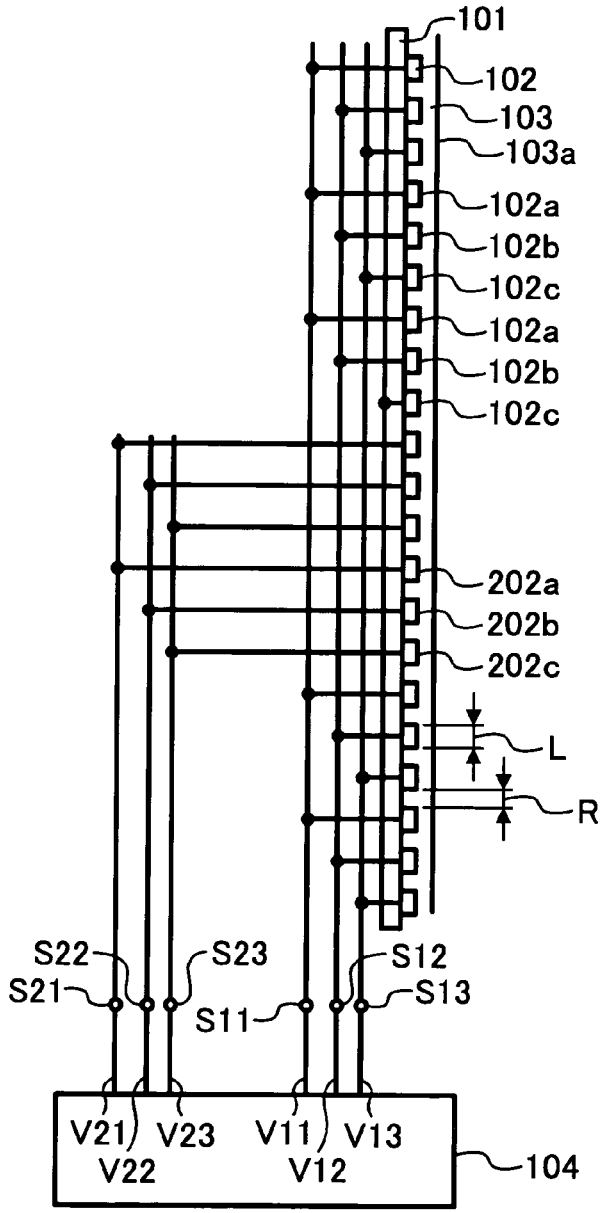
FIG. 3 is an enlarged cross section of the part of an electrostatic conveyance roller of the development device, opposing a photoconductor.

FIG. 3 schematically illustrates the vicinity of the part of the electrostatic conveyance roller 13 opposing the photoconductor 11. In the electrostatic conveyance roller 13, a plurality of electrodes 102 is arranged on a support plate 101 at predetermined intervals "R" in the moving direction of toner particles. Three-phase drive voltage is applied to the electrodes 102 in the printer 100, and the electrodes 102 are classified into a first electrode 102*a*, a second electrode 102*b*, and a third electrode 102*c* according to the difference in the phase of the applied drive voltage. When differentiating the electrodes 102 from each other is not necessary in the description, each of the first electrode 102*a*, the second electrode 102*b*, and the third electrode 102*c* is simply referred to as the electrode 102. Further, in the electrostatic conveyance roller 13, a surface protection layer 103 is formed on the electrodes 12 by inorganic or organic insulating material to serve as a protection layer covering the surfaces of the electrodes 102. The surface protection layer 103 forms an electrostatic conveyance surface 103*a* over the electrodes 102.

As the support plate 101, a base plate made of insulating material, such as a glass base plate, a resin base plate, and a ceramic base plate, a base plate made of conductive material, such as SUS, on which an insulating film, such as $SiO_2$, has been formed, and a base plate made of flexible material, such as a polyimide film, may be used.

The electrode 102 is formed by patterning a film of conductive material, such as Al, Ni—Cr, etc, which has been formed on the support base plate 101, 0.1-10.0 μm thick, preferably, 0.5-2.0 μm thick, using photolithography. The width "L" of the electrode 102 in the moving direction of toner particles is made to be between the average particle diameter of the toner particles and ten times thereof, and the gap R between the electrodes 102 in the moving direction of the toner particles is also made to be between the average particle diameter of the toner particles and ten times thereof.

The surface protection layer 103 is formed by forming a film of $SiO_2$, $TiO_2$, $TiO_4$, SiON, BN, TiN, $Ta_2O_5$, etc., 0.5-10 μm thick, preferably 0.5-3 μm thick.

In FIG. 3, lines downwardly extending from respective electrodes 102 schematically represent conductive lines for applying voltages to respective electrodes 102, and among overlapped parts of respective lines, only the parts indicated by black circles are electrically connected and other overlapped parts are electrically insulated. Different drive voltages of a plural-phase are applied to the electrodes 102 from a power source 104 of the main body. The description will be made for the case of applying three-phase drive voltage, however, drive voltage of "n"-phase, "n" being an arbitrary natural number satisfying the condition of n>2, can be applied as long as toner particles are moved.

Each electrode 102 is connected with one of a first contact point S11, a second contact point S12, a third contact point S13, a first development contact point S21, a second development contact point S22, and a third development contact point S23 at the side of the development device 10. In the state that the development device 10 has been installed to the main body of the printer 100, respective contact points are connected with the power source 104 of the main body, which provides a first drive waveform V11, a second drive waveform V12, a third drive waveform V13, a first development drive waveform V21, a second development drive waveform V22, and a third development drive waveform V23 to respective contact points.

The electrostatic conveyance roller 13 is divided into an electric field area where a phase-shifting electric field is generated and a non-electric field area where the phase-shifting electric field is not generated, and the electric field area is divided into a development area for causing toner particles to adhere to a latent image on the photoconductor 11 to form a toner image and a conveyance area for moving toner particles to the vicinity of the photoconductor 11 and for collecting the toner particles passed the development area without contributing to development, which will be described more in detail later. The development area exists only in a part of the electric field area close to the photoconductor 11, and the conveyance area exists in the whole area of the electric field area except the development area.

Hereinafter, the area of the electrostatic conveyance roller 13 where toner particles can move by the phase-shifting electric field is referred to as the electrostatic conveyance surface. In the electrostatic conveyance roller 13, the whole surface of the electrostatic conveyance roller 13 except the non-electric field area is the electrostatic conveyance surface.

In the conveyance area, for each electrode 102, the first drive waveform V11 is applied to the first electrode 102*a*, the second drive waveform V12 is applied to the second electrode 102*b*, and the third drive waveform V13 is applied to the third electrode 102*c*. In the development area, for each electrode 102, the first development drive waveform V21 is applied to a first development electrode 202*a*, the second drive waveform V22 is applied to a second development electrode 202*b*, and the third drive waveform V23 is applied to a third development electrode 202*c*.

Now, the principle of electrostatic conveyance of toner particles by the electrostatic conveyance roller 13 is described.

By applying n-phase drive voltage to the plurality of electrodes 102 of the electrostatic conveyance roller 13, a phase-shifting (progressive wave) electric field is generated by the plurality of electrodes 102, and toner particles on the electrostatic conveyance roller 13 that have been charged move in the direction of movement of the phase-shifting electric field by receiving a repulsion force and/or an attraction force of the phase-shifting electric field as described more in detail later.

Figure 4:
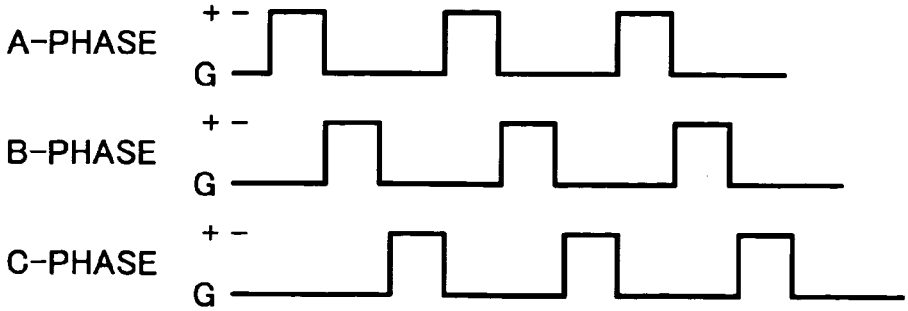
FIG. 4 is a diagram for explaining waveforms when three-phase pulsed drive waveforms are applied to a plurality of electrodes of the electrostatic conveyance roller while delaying the timing of applying the drive waveforms.
Figure 5:
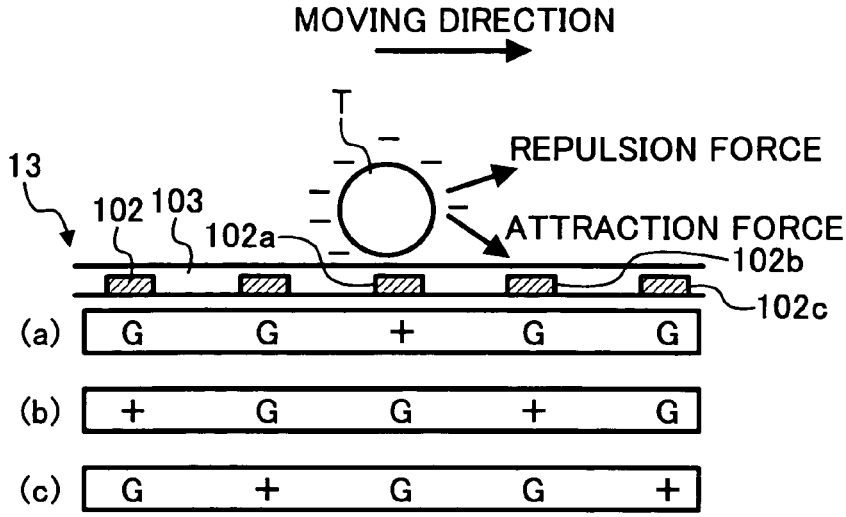
FIG. 5 is a diagram for explaining a change in the polarity applied to the plurality of electrodes at consecutive three timings.

FIG. 4 is a diagram for explaining waveforms when three-phase (an A-phase, a B-phase, and a C-phase) pulsed drive waveforms, which change between a ground "G" (0V) and a positive voltage "+", are applied to the plurality of electrodes 102 of the electrostatic conveyance roller 13 while delaying the timing of applying the drive waveforms. FIG. 5 is a diagram for explaining a change in the polarity applied to the plurality of electrodes 102 at consecutive three timings (a), (b), and (c) at that time.

As illustrated in FIG. 5, when negatively-charged toner particles "T" exist on the electrostatic conveyance roller 13, if the polarities "G", "G", "+", "G", and "G" are applied to the consecutive electrodes 102 of the electrostatic conveyance roller 13, respectively, at the timing (a), the negatively-charged toner particles T are positioned on the first electrode 102*a* to which the "+" polarity has been applied.

At the next timing (b), the polarities "+", "G", "G", and "G" are applied to the plurality of electrodes 102, respectively. Specifically, the polarity applied to the first electrode 102*a* is "G", and the polarity applied to the second electrode 102*b* is "+". At this time, because both of a repulsion force from the first electrode 102*a* to which the polarity "G" has been applied and an attraction force from the second electrode 102*b* to which the polarity "+" has been applied act on the negatively-charged toner particles T, the negatively-charged toner particles T move to the second electrode 102*b*.

Further, at the next timing (c), the polarities "G", "+", "G", "G", and "+" are applied to the plurality of electrodes 102, respectively. At this time, similarly, because a repulsion force from the second electrode 102*b* to which the polarity "G" has been applied and an attraction force from the third electrode 102*c* to which the polarity "+" has been applied act on the negatively charged toner particles T, the negatively-charged toner particles T move to the third electrode 102*c*.

Thus, by applying drive waveforms of a plurality of phases, which change in voltage, to the plurality of electrodes 102, a phase-shifting (progressive wave) electric field is generated on the electrostatic conveyance roller 13, and negatively charged toner particles T on the electrostatic conveyance roller 13 move in the direction of movement of the phase-shifting (progressive wave) electric field. When positively charging toner particles are used, by reversing the changing pattern of the drive waveforms, the toner particles positively charged move in the direction of movement of the phase-shifting (progressive wave) electric field.

Figure 6:
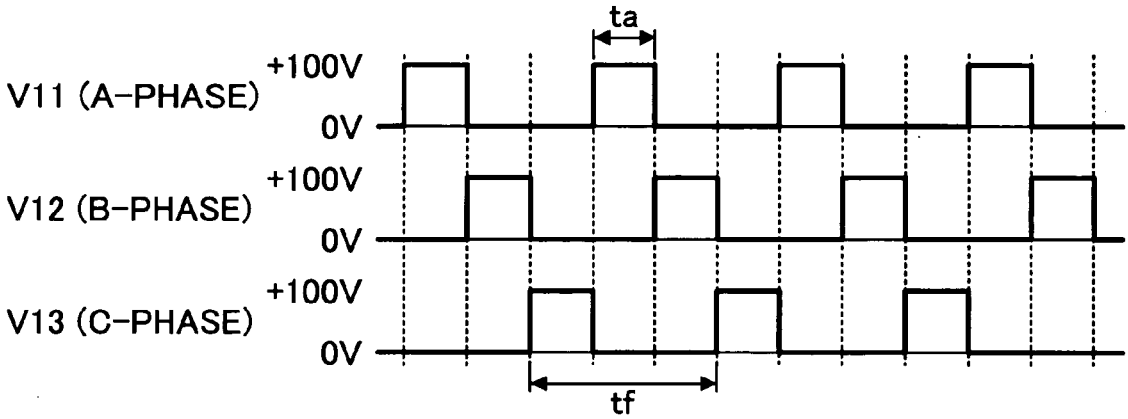
FIG. 6 is a diagram illustrating waveforms of three-phase pulsed drive waveforms applied to the electrodes in the conveyance area of the electrostatic conveyance roller.

FIG. 6 is a diagram illustrating waveforms of an A-phase drive pulse voltage, a B-phase drive pulse voltage, and a C-phase drive pulse voltage, which are applied to the electrodes 102 in the conveyance area of the electrostatic conveyance roller 13.

In the conveyance area of the electrostatic conveyance roller 13, three-phase drive waveforms, the first drive waveform V11, the second drive waveform V12, and the third drive waveform V13, in which, as illustrated in FIG. 6, an application time "ta" of +100V in each phase is set to be about 33% (⅓) of a repeating cycle "tf", which pattern being referred to as "conveyance voltage pattern", are applied to respective electrodes 102. It has been known from the studies of the present applicant that the above-described drive waveforms are the ones suitable for moving toner particles at a high speed in the conveyance area of the electrostatic conveyance roller 13.

Figure 7:
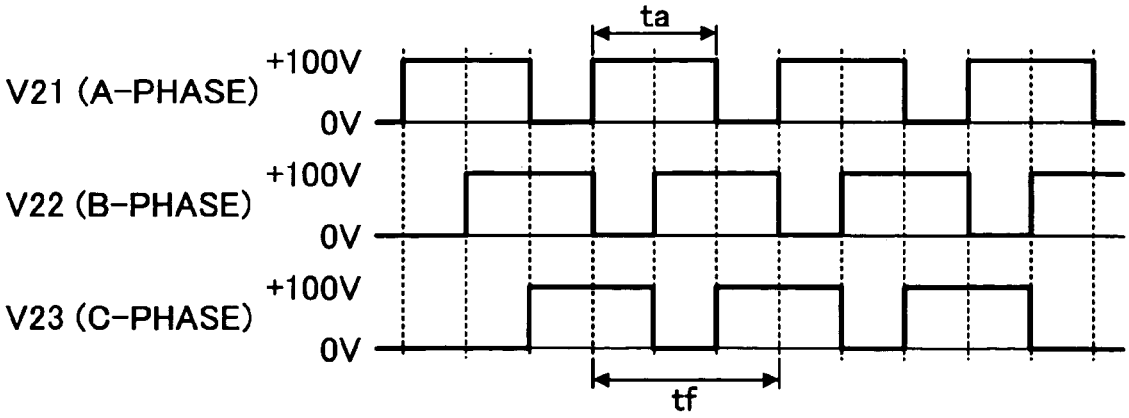
FIG. 7 is a diagram illustrating waveforms of three-phase pulsed drive waveforms applied to the electrodes in the development area of the electrostatic conveyance roller.

FIG. 7 is a diagram illustrating waveforms of an A-phase drive pulse voltage, a B-phase drive pulse voltage, and a C-phase drive pulse voltage, which are applied to the electrodes 102 in the development area of the electrostatic conveyance roller 13.

In the development area of the electrostatic conveyance roller 13, three-phase drive waveforms, the first development drive waveform V21, the second development drive waveform V22, and the third development drive waveform V23, in which, as illustrated in FIG. 7, the application time "ta" of +100V or 0V in each phase is set to be about 67% (⅔) of the repeating cycle "tf", which pattern being referred to as "development voltage pattern", are applied to respective electrodes 102. In the development area, it is preferable to raise the toner particles on the electrostatic conveyance roller 13 toward the photoconductor 11 in a positive manner, and it has been known from the studies of the present applicant that the above-described drive waveforms are the ones suitable for raising the toner particles on the electrostatic conveyance roller 13 toward the photoconductor 11.

Even when the drive waveforms of the development voltage pattern are applied to the electrodes 102, toner particles other than the ones at the center of the 0V electrode 102 receive a lateral movement force, so that all of the toner particles do not necessarily rise high at once, and some of the toner particles move in the horizontal direction. On the other hand, even when the drive waveforms of the conveyance voltage pattern are applied to the electrodes 102, some of the toner particles rise slantingly at a relatively large angle, so that depending on the position of the toner particles, the moving distance of the toner particles in the vertical direction is greater than the moving distance in the horizontal direction.

Accordingly, the drive waveform pattern applied to the electrodes 102 in the conveyance area is not limited to the above-described conveyance voltage pattern illustrated in FIG. 6, and the drive waveform pattern applied to the electrodes 102 in the development area is not limited to the above-described development voltage pattern illustrated in FIG. 7.

When generating a phase-shifting (progressive wave) electric field by applying n-phase ("n" being an integer equal to or greater than 3) pulse voltages (drive waveforms) to each electrode, the development efficiency can be raised by making the voltage application time "ta" per one phase smaller than {(repeating cycle time "tf")×(n−1)/n}. For example, when using 3-phase drive waveforms, the voltage application time "ta" for each phase is set to be smaller than about 67%, that is, ⅔, of the repeating cycle time "tf", and when using 4-phase drive waveforms, the voltage application time "ta" for each phase is preferably set to be smaller than 75%, that is, ¾, of the repeating cycle time "tf".

On the other hand, in the conveyance area, the voltage application time "ta" is preferably set to be equal to or greater than {(repeating cycle time "tf")/n}. For example, when using 3-phase drive waveforms, the voltage application time "ta" for each phase is preferably set to be equal to or greater than about 33%, that is, ⅓, of the repeating cycle time "tf". That is, in applying voltages to an observation electrode, an upstream side neighbouring electrode, and a downstream side neighbouring electrode, by providing a time that the upstream side neighbouring electrode repulses and the downstream side neighbouring electrode attracts, the conveyance efficiency can be enhanced. In particular, when the drive frequency is relatively high, by setting the voltage application time "ta" to be equal to or greater than {(repeating cycle time "tf")/n} and smaller than {(repeating cycle time "tf")×(n−1)/n}, the initial conveyance speed of the toner particles on the observation electrode can be easily obtained.

The configuration of the electrostatic conveyance roller 13 as the electrostatic conveyance device is not limited to the one described above, and the electrostatic conveyance roller 13 may be configured otherwise as long as desired toner particle conveyance and development performances can be obtained. For example, the interval of the electrodes 102 may be changed in the development area from that in the conveyance area to adjust the direction of the electric field, or the interval of the electrodes 102 and the drive waveforms may be made substantially the same in the conveyance area and the development area.

Now returning to FIG. 2, in the development device 10, as described above, the supply roller 15 is arranged to supply toner particles to the electrostatic conveyance roller 13. A magnetic brush is formed at a part of the supply roller 13 opposing the electrostatic conveyance roller 13 to supply the toner particles to the electrostatic conveyance roller 13. A cylindrical non-magnetic sleeve 15*a* made of a non-magnetic member, such as aluminum, brass, stainless, conductive resin, etc., is formed on the surface of the supply roller 15. The sleeve 15*a* is driven by a rotation drive mechanism (not shown) in the clockwise direction indicated by an arrow C in figure.

Two-component developer including toner particles and magnetic carriers (not shown) is accommodated in the developer accommodation part 18 covered by a development casing 10*a*. The developer used in the printer 100 is not limited to two-component type developer, and the present invention can be applied to the development device 10 using developer of other types.

A doctor blade 16 is arranged upstream of a supply area of the supply roller 15 in the developer conveyance direction where developer is supplied to the electrostatic conveyance roller 13 to regulate the quantity of the developer born on the sleeve 15*a*. A doctor gap between the doctor blade 16 and the sleeve 15*a* is set to be about 0.4 mm. Two stirring screws 17 are arranged at the left side of the supply roller 15 in figure to stir the developer in the developer accommodation part 18 and to scoop up the developer to the supply roller 15.

Figure 8:
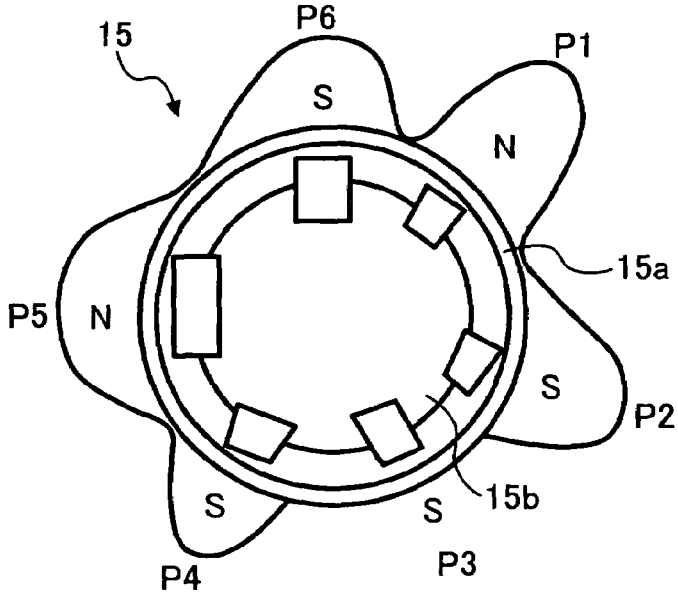
FIG. 8 is a cross section of a supply roller of the development device, supplying toner particles to the electrostatic conveyance roller.

FIG. 8 is a cross section of the supply roller 15. A magnet roller 15*b* is fixedly arranged inside of the supply roller 15 to form a magnetic field causing the developer on the circumferential surface of the sleeve 15*a* to rise like ears. Carriers of the developer on the sleeve 15*a* are caused to rise like a chain of ears along a magnetic force line emitted from the magnet roller 15*b* in the normal line direction, and charged toner particles are caused to adhere to the carriers formed like the chain of ears, and thereby the magnetic brush (not shown) is formed. The magnetic brush is moved in the direction in which the sleeve 15*a* moves by rotation of the sleeve 15*a*. The magnet roller 15*b* includes a plurality of magnetic poles (magnets). Specifically, the magnet roller 15*b* includes a main pole P1, which causes the developer to rise like ears in the supply area where the developer is supplied to the electrostatic conveyance roller 13, scoop poles P4 and P5, which scoop up the developer onto the sleeve 15*a*, a conveyance pole P6, which conveys the scooped up developer to the supply area, a conveyance pole P2, which conveys the developer passed the supply area in the area after the supply area, and a release pole P3, which releases the developer from the sleeve 15*a* to be returned to the developer accommodation part 18. The magnet roller 15*b* is constructed by a magnet having 6 poles, however, may be constructed by a magnet having 8 or 12 poles. The curved lines illustrated on the surface of the supply roller 15 in FIG. 8 indicate the outline of magnetic force lines, and symbols "N" and "S" indicate that the polarities of respective poles at the surface side of the supply roller 15 are the N-pole and the S-pole, respectively.

The toner particles of the developer used in the printer 100 are non-magnetic toner particles having the weight-average particle diameter of about 5 μm. The toner particles may be obtained by adding a coloring agent and a charge control agent to binder resin and by granulating the binder resin. As the binder resin, styrene or acrylic polymerizing monomer, which has been radically polymerized in the state of being dispersed in water together with a polymerization initiator, or polyester resin, which has been dispersed in water and highly polymerized by a polyaddition behavior, may be used.

The magnetic carriers are preferably those having the quantity of magnetization in the magnetic field of 1 kilooersted in the range from 30 emu/cm$^3$ to 200 emu/cm$^3$. When the quantity of magnetization is equal to or smaller than 200 emu/cm$^3$, preferably, equal to or smaller than 140 emu/cm$^3$, a magnetic interaction between neighboring ears of the magnetic brush becomes weak so that the ears of the magnetic brush become thick and short. As the result, uniform supplying of toner particles to the electrostatic conveyance roller 13 can be attained.

On the other hand, when the quantity of magnetization of the magnetic carriers is smaller than 30 emu/cm$^3$, the developer conveyance performance deteriorates. Accordingly, the quantity of magnetization of the magnetic carriers is preferably at least equal to or greater than 30 emu/cm$^3$, more preferably equal to or greater than 80 emu/cm$^3$.

As the magnetic carriers, resin magnetic carriers are used, in which at least binder resin, and magnetic substance, which is consisted of magnetic metal oxide and non-magnetic metal oxide and which has been generated by polymerization, are dispersed. Specifically, magnetite ($Fe_3O_4$) is used as the magnetic metal oxide, and resin obtained by polymerization of vinyl polymer, such as styrene, ethyl acrylate, etc., is used as the binder resin. Carriers, in which magnetic substance has been dispersed in the binder resin, may be also used. Further, coated magnetic carriers obtained by coating surfaces of such carriers, in which magnetic substance has been dispersed in the binder resin, with insulating resin, may be used. The quantity of magnetization of magnetic carriers may be obtained by multiplying the magnetization intensity of the carriers with the true specific gravity of the carriers. The magnetization intensity of the carriers can be obtained, using a vibration type magnetic property automatic recording apparatus of RIKEN DENSHI CO., LTD., in which the magnetic carriers packed in a cylinder container is placed in the external magnetic field of 1 kilooersted and the magnetization intensity thereof is measured.

Now, the image forming operation of the printer 100 is described.

The printer 100 functions as a copying machine and a printer. When the printer 100 functions as the copying machine, image information is obtained by a scanner (not shown) and the obtained image information is converted to writing data after having been processed with various image processes, such as analogue to digital conversion, MTF correction, gradation correction, etc. When the printer 100 functions as the printer, image information transferred from a computer (not shown) in the forms of page description language, bit maps, etc. is converted to writing data after having been processed with various image processes.

The photoconductor 11 is rotated in the direction indicated by the arrow B, that is, in the counterclockwise direction, in FIG. 2 such that the surface thereof moves at a predetermined speed. The charge roller 12 is rotated by rotation of the photoconductor 11. At this time, direct current voltage Of −100V and alternate current voltage of 1200V and 2 kHz frequency are applied to the metal core 12*a* of the charge roller 12 from a charge bias voltage application power source (not shown), and thereby the surface of the photoconductor 11 is uniformly charged to about −100V.

Exposure according to writing data is performed to the charged surface of the photoconductor 11 by the optical writing device 4. That is, by changing the electric potential of the image part on the surface of the photoconductor 11 with illumination of a light beam 4*a* emitted from the optical writing device 4, an electric potential difference is generated between the image part and the non-image part on the surface of the photoconductor 11, and thereby an electrostatic latent image is formed according to the potential difference.

The electrostatic-latent image formed on the photoconductor 11 by the optical writing device 4 is developed with the development device 10. Specifically, by causing toner particles to adhere to the latent image, the latent image is visualized as a toner image on the photoconductor 11. The toner particles move while leaping on the surface of the electrostatic conveyance roller 13 by the phase-shifting electric field, and when the toner particles reach near the photoconductor 11, the toner particles are attracted and adhere to the image part (latent image) on the photoconductor 11, and thereby the latent image is developed with the toner particles. The voltage of −50V is applied to the electrostatic conveyance roller 13 and the voltage of −250V is applied to the supply roller 15, and thereby the electric fields are formed to guide the toner particles from the supply roller 15 to the electrostatic conveyance roller 13 and from the electrostatic conveyance roller 13 to the image part (latent image) on the photoconductor 11.

The transfer sheet P is conveyed from the feed device 5 to be synchronized with the timing that the toner image on the photoconductor 11 reaches a nip part of the transfer roller 9 and the photoconductor 11 serving as a transfer part, and the toner image on the photoconductor 11 is transferred onto the transfer sheet P by the voltage applied to the transfer roller 9. The toner image is fixed to the transfer sheet P by the fixing device 3, and thereby an image is formed on the transfer sheet P.

The cleaning device 14 removes residual toner remaining on the surface of the photoconductor 11 so that the surface of the photoconductor 11 is ready for subsequent image formation.

Now, description is made with respect to the toner collection device 20 collecting toner particles from the electrostatic conveyance surface 103*a* of the electrostatic conveyance roller 13 at the downstream side of the development area of the electrostatic conveyance roller 13.

Figure 9:
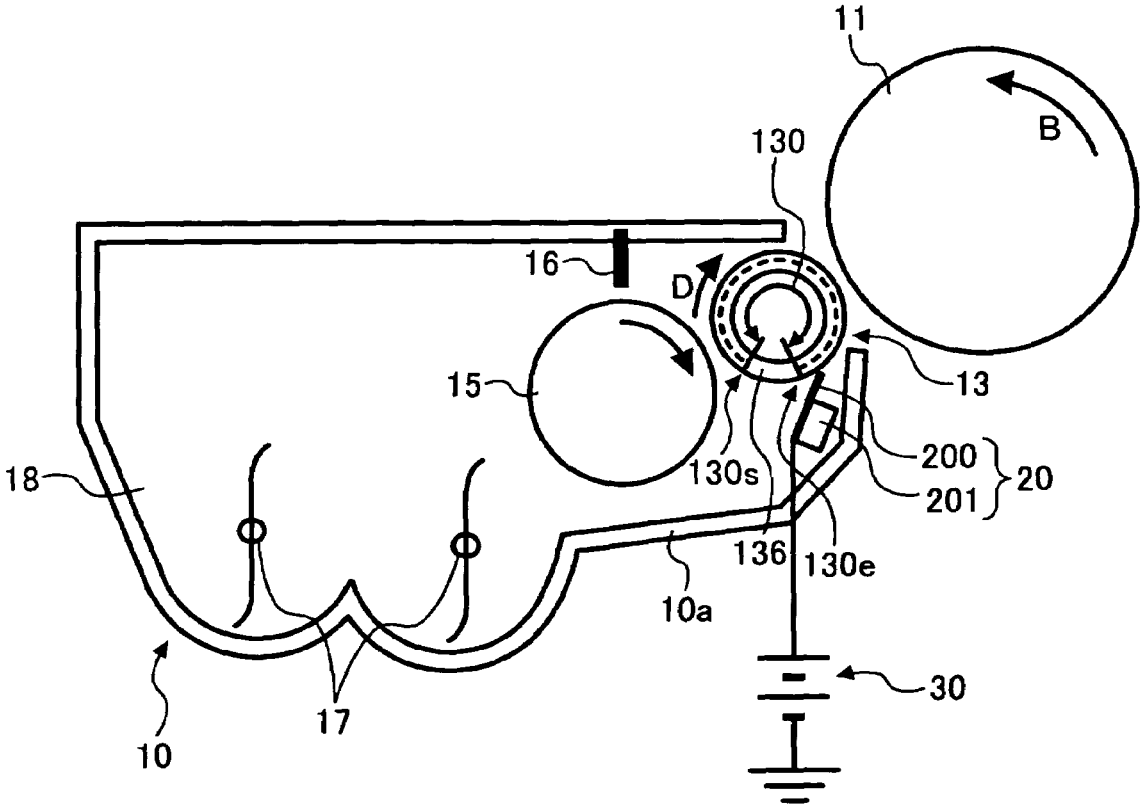
FIG. 9 is a diagram schematically illustrating the development device including the first example of a toner collection device and the photoconductor.

FIG. 9 is a diagram schematically illustrating the development device 10 including the first example of the toner collection device 20 and the photoconductor 11. As illustrated in figure, the first example of the toner collection device 20 includes a conductive plate 200 as a collection member collecting toner particles.

The toner particles supplied by the supply roller 15 onto the electrostatic conveyance roller 13 move on the surface of the electrostatic conveyance roller 13 in the direction of an arrow D in figure due to the phase-shifting electric field generated in an electric field area 130 of the electrostatic conveyance roller 13. A non-electric field area 136 where the phase-shifting electric field is not generated is formed between a conveyance electrode start part 130*s* of the electric field area 130 where the phase-shifting electric field starts and a conveyance electrode end part 130*e* of the electric field area 130 where the phase-shifting electric field ends.

The conductive plate 200 is arranged not to contact the electrostatic conveyance surface 103*a* of the electrostatic conveyance roller 13 in the area between the development area and the toner supply area of the electrostatic conveyance roller 13 as described later more in detail. Further, bias voltage of the polarity opposite that of the toner particles is applied as collection voltage to the conductive plate 200 by a collection power source 30. Because the toner particles are usually negatively (−) charged, the collection voltage applied to the conductive plate 200 is set to be positive (+).

The conveyance electrode part of the electrostatic conveyance roller 13 where the conveyance electric field is generated extends from the toner supply area to the collection area where toner collection device is arranged.

The toner particles moving on the electrostatic conveyance roller 13 that did not contribute to development in the development area of the electrostatic conveyance roller 13 passes the development area and are electrostatically attracted to the conductive plate 200, to which the bias voltage has been applied, and are separated from the electrostatic conveyance roller 13. The bias voltage in the range from 0V to +100V is applied to the conductive plate 200.

The gap between the conductive plate 200 and the electrostatic conveyance roller 13 is smaller than the height the toner particles leap on the electrostatic conveyance roller 13 when the toner particles are moved by the phase-shifting electric field, and is in the range of 50-1000 μm, preferably in the range of 150-400 μm. In the development device 10 illustrated in FIG. 9, the conductive plate 200 is separated about 400 am from the electrostatic conveyance roller 13.

The toner particles attracted to the conductive plate 200 are made electrostatically repulsive relative to the electrostatic plate 200 by applying the voltage of the polarity, opposite that of the bias voltage applied when attracting the toner particles, to the conductive plate 200 at the timing that movement of the toner particles is not performed by the electrostatic conveyance roller 13, and thereby the toner particles attracted to the conductive plate 200 are removed from the conductive plate 200. Further, by removing the charge of the conductive plate 200 by grounding the conductive plate 200, the toner particles are fallen from the conductive plate 200 by gravity, and thereby the toner particles are collected in the development device 4. The conductive plate 200 may be slantingly arranged in the perpendicular direction so that the toner particles are easily fallen from the conductive plate 200. To facilitate falling of toner particles from the conductive plate 200, a vibrator 201 using a piezoelectric element, etc. may be provided to the conductive plate 200 to add vibration, such as ultrasonic vibration and high frequency vibration, to the conductive plate 200.

The toner particles fallen off the conductive plate 200 and collected in the development device 4 are caught again by the developer on the supply roller 15 and are conveyed to the supply area to be supplied to the electrostatic conveyance roller 13.

Figure 10:
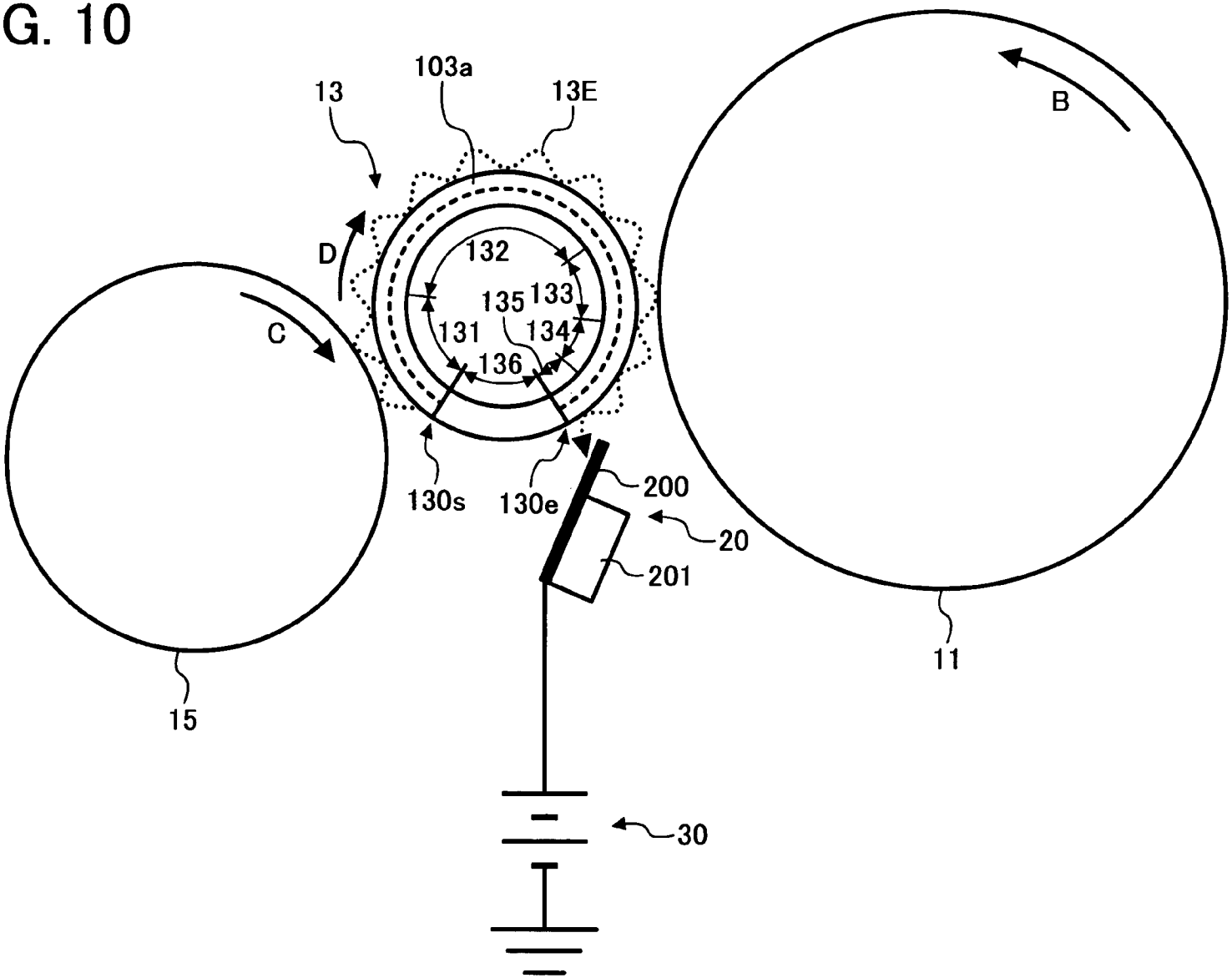
FIG. 10 is a diagram for explaining the electrostatic conveyance roller more in detail.

FIG. 10 is a diagram for explaining the electrostatic conveyance roller 13 as the electrostatic conveyance device more in detail. In the electrostatic conveyance roller 13 illustrated in FIG. 10, reference numeral 131 denotes a supply area 131 where toner particles are supplied by the supply roller 15, reference numeral 132 denotes an upstream side conveyance area 132 where the toner particles supplied from the supply roller 15 are moved in the toner conveyance direction, reference numeral denotes the development area 133 opposing the photoconductor 11, reference numeral 134 denotes a downstream side conveyance area where the toner particles passed the development area 133 are moved in the toner conveyance direction, and reference numeral 135 denotes a collection area where the conductive plate 200 as the toner collection device is arranged. The supply area 131, the upstream side conveyance area 132, the development area 133, the downstream side conveyance area 134, and the collection area 135 constitute the electric field area 130 where a conveyance electric field 13E as the phase-shifting electric field is generated. Here, strict boundaries do not necessarily exist between respective areas constituting the electric field area 130. Further, the part of the non-electric field area 136 of the electrostatic conveyance roller 13 may be formed using an insulating member. Thereby, generation of an electric field at the non-electric field area 136 can be more reliably suppressed.

Figure 11:
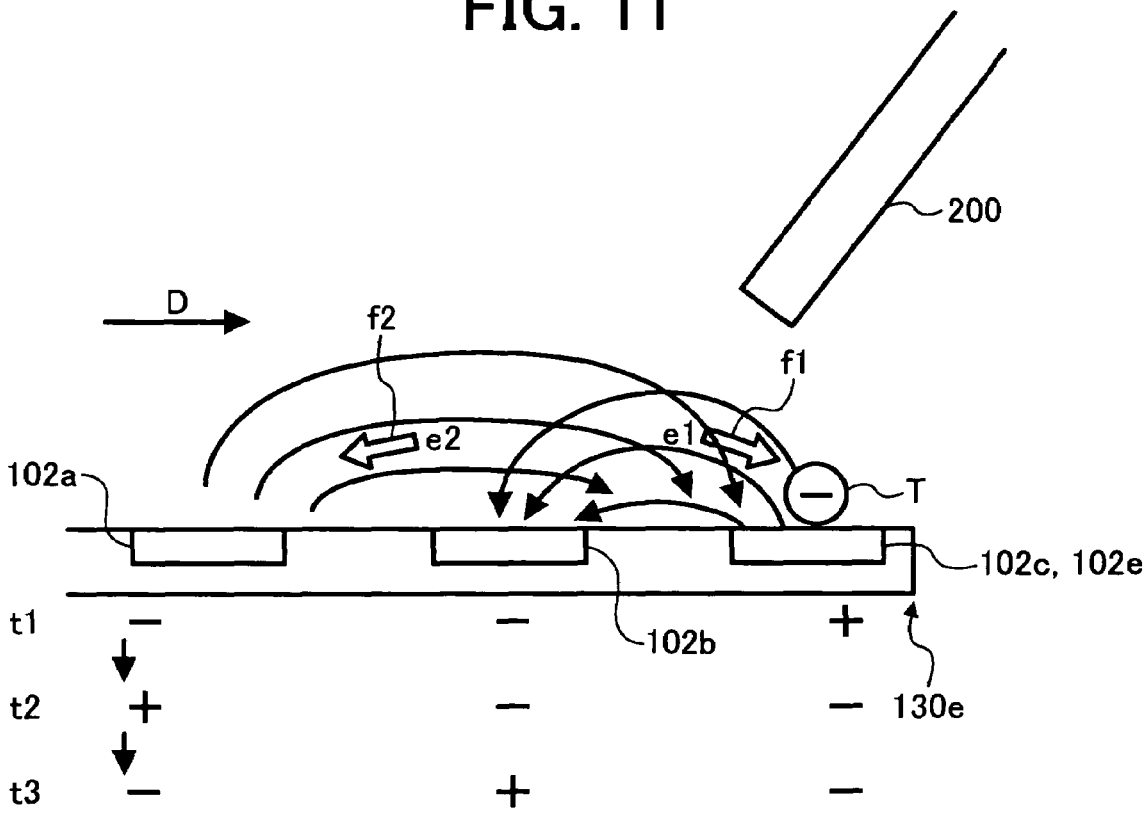
FIG. 11 is a diagram for explaining changes in the polarities of the plurality of electrodes and the electrostatic force added to toner particles in a collection area of the electrostatic conveyance roller.

FIG. 11 is a diagram for explaining changes in the polarities of the plurality of electrodes 102 and electrostatic forces added to toner particles in the collection area 135.

Among the plurality of electrodes 102 in the collection area 135, a downstream end part electrode 102*e* is the electrode that is closest to the conveyance electrode end part 130*e* (corresponding to the downstream side end of the phase-shifting electric field 130) and is the most downstream end side electrode of the electric field area 130. Here, the electrode 102 immediately at the upstream side of the downstream end part electrode 102*e* is the second electrode 102*b*, the electrode 102 at the upstream side of the second electrode 102*b* is the first electrode 102*a*, and the downstream end part electrode 102*e* is the third electrode 102*c*. The polarities indicated below respective electrodes 102 in figure indicate the polarities of voltages applied to respective electrodes 102 at timings t1, t2, and t3.

The position of the toner particles T in FIG. 11 is the one after the polarities of the voltages applied to the electrodes 102 have been changed from the ones at the timing of t3 to the ones at the timing of t1. That is, the polarity of the voltage applied to the second electrode 102*b* is changed from "+" to "−", and the polarity of the voltage applied to the downstream end part electrode 102*e* is changed from "−" to "+", and thereby an electric field "e1" is generated. Thereby, an electrostatic force "f1" acts on the toner particles T that has been located on the second electrode 102*b*, and the toner particles T are moved in the direction of the arrow D, which is the toner conveyance direction, to the position illustrated in FIG. 11.

Thereafter, even when the polarities of the voltages applied to the electrodes 102 are changed from the ones at the timing of t1 to the ones at the timing t2, because no electrode 102 exists at the downstream side of the downstream end part electrode 102*e*, the conveyance electric field to convey the toner particles T in the direction of the arrow D in figure is not formed. At this time, the polarity of the voltage applied to the downstream end part electrode 102*e* is changed from "+" to "−", and the polarity of the voltage applied to the first electrode 102*a* is changed from "−" to "+", and thereby an electric field "e2" is generated. Thereby, an electrostatic force "f2" acts on the toner particles T on the downstream end part electrode 102*e*, so that the toner particles T are moved in the opposite direction of the direction of the arrow D (toner conveyance direction) to arrive on the first electrode 102*a*.

Thus, the toner particles T repeat progressing and backing in the periphery of the conveyance electrode end part 130*e*, which is the boundary between the collection area 135 and the non-electric field area 136. Therefore, by providing a toner collection device so as to collect the toner particles in the periphery of the conveyance electrode end part 130*e*, the toner particles passed the development area 133 can be securely collected. Accordingly, the conductive plate 200 to which the bias voltage is applied is arranged as the toner collection device in the periphery of the conveyance electrode end part 130*e*. By providing the conductive plate 200 in the periphery of the conveyance electrode end part 130*e*, the chance increases that the toner particles passed the development area 133 are caught by the collection electric field of the conductive plate 200, so that collection of the toner particles is facilitated.

Figure 12:
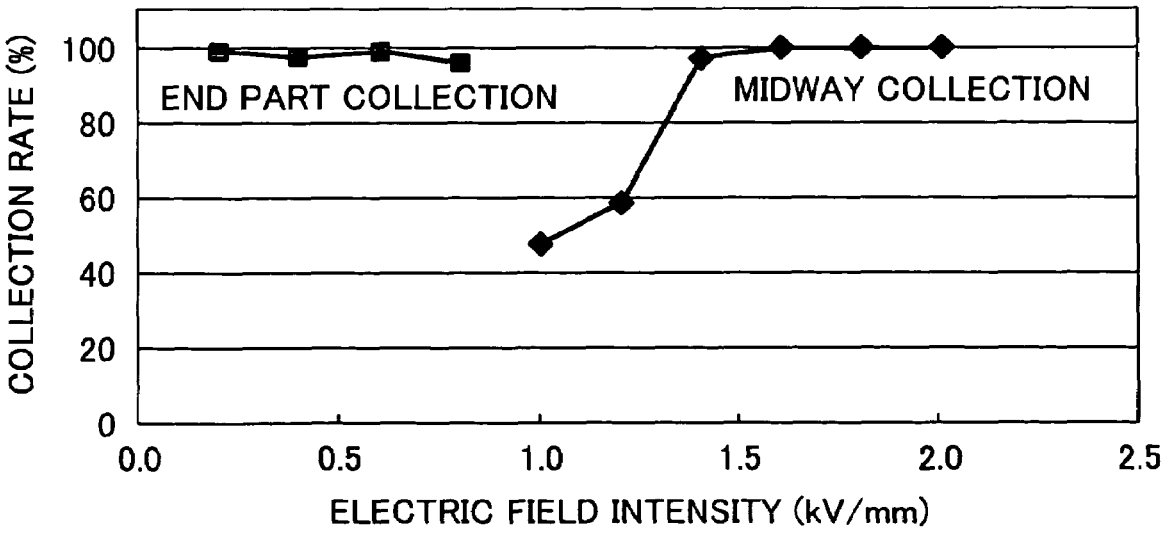
FIG. 12 is a diagram indicating a result of an experiment performed for confirming the collection efficiency at a conveyance electrode end part of the electrostatic conveyance roller.

FIG. 12 is a diagram indicating a result of an experiment 1 performed for confirming the collection efficiency at the conveyance electrode end part 130*e*. In the experiment 1, the intensity of a collection electric field generated by applying a voltage to the conductive plate 200 and the collection rate have been measured for the case that the conductive plate 200 is arranged in the periphery of the conveyance electrode end part 103*e* (end part collection) and for the case that the conductive plate 200 is arranged along the electric field area 130 (midway collection).

As indicated in FIG. 12, when the conductive plate 200 is arranged in the periphery of the conveyance electrode end part 130*e*, the toner particles are collected at the electric field intensity of ⅓ or smaller as compared with the case that the conductive plate 200 is arranged along the electric field area 130. From the experiment 1, it has been confirmed that by providing the conductive plate 200 to collect the toner particles in the periphery of the conveyance electrode end part 103*e*, the toner particles passed the development area 133 can be collected more securely.

In the above-described first example of the toner collection device 20, the conductive plate 200 constituted by a blade-like shaped member is used as the collection member. However, the collection member constituting the toner collection device 20 is not limited to such a blade-like shaped member.

Figure 13:
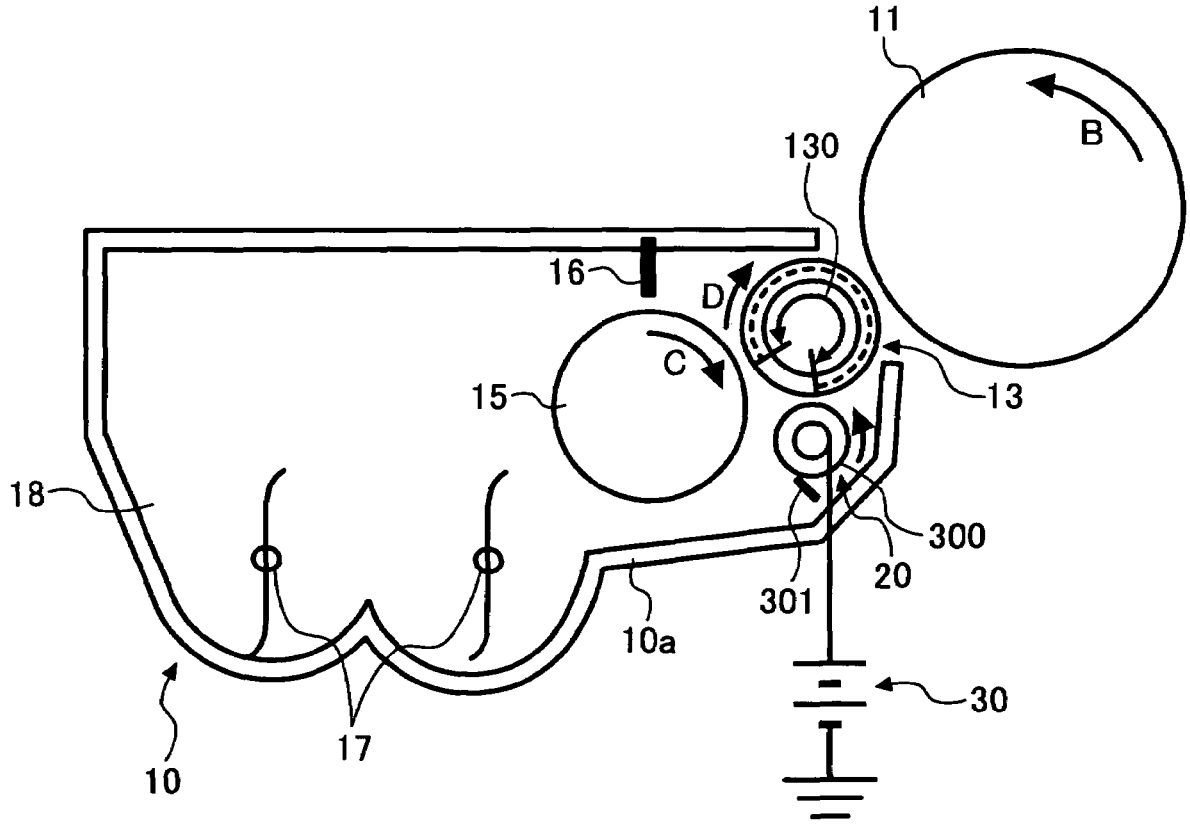
FIG. 13 is a diagram illustrating the photoconductor and the development device including the second example of the toner collection device.

FIG. 13 is a diagram illustrating the photoconductor 11 and the development device 10 including the second example of the toner collection device 20. As illustrated in figure, the second example of the toner collection device 20 includes a conductive roller 300 in a roller shape as the collection member.

The conductive roller 300 is arranged not to contact the electrostatic conveyance surface 103*a* of the electrostatic conveyance roller 130 in the area between the development area and the toner collection area of the electrostatic conveyance roller 13. The bias voltage of the polarity opposite that of the toner particles is applied to the conductive roller 300 as the collection voltage by the collection power source 30.

As described above, the toner particles supplied by the supply roller 15 onto the electrostatic conveyance roller 13 move on the surface of the electrostatic conveyance roller 13 in the direction of the arrow D in figure by the phase-shifting electric field generated in the electric field area 130 of the electrostatic conveyance roller 13. The non-electric field area 136 where the phase-shifting electric field is not generated is formed between the conveyance electrode start part 130*s* of the electric field area 130 where the phase-shifting electric field starts and the conveyance electrode end part 130*e* of the electric field area 130 where the phase-shifting electric field ends.

The toner particles that did not contribute to development in the development area passes the development area of the electrostatic conveyance roller 13 and are electrostatically attracted to the conductive roller 300, to which the bias voltage is applied, to be separated from the electrostatic conveyance roller 13. The bias voltage in the range from 0V to +100V is applied to the conductive roller 300.

The conductive roller 300 is provided slightly separated from the electrostatic conveyance roller 13 and is rotated. By rotation of the conductive roller 300, the toner particles attracted to the conductive roller 300 are scraped off the conductive roller 300 by a removable blade 301 arranged to contact the surface of the conductive roller 300. The scraped toner particles fall down by gravity to be collected in the development device 10. The toner particles collected in the development device 10 are caught again by the developer on the supply roller 15 and are conveyed to the supply area where the developer is supplied to the electrostatic conveyance roller 13.

Figure 14:
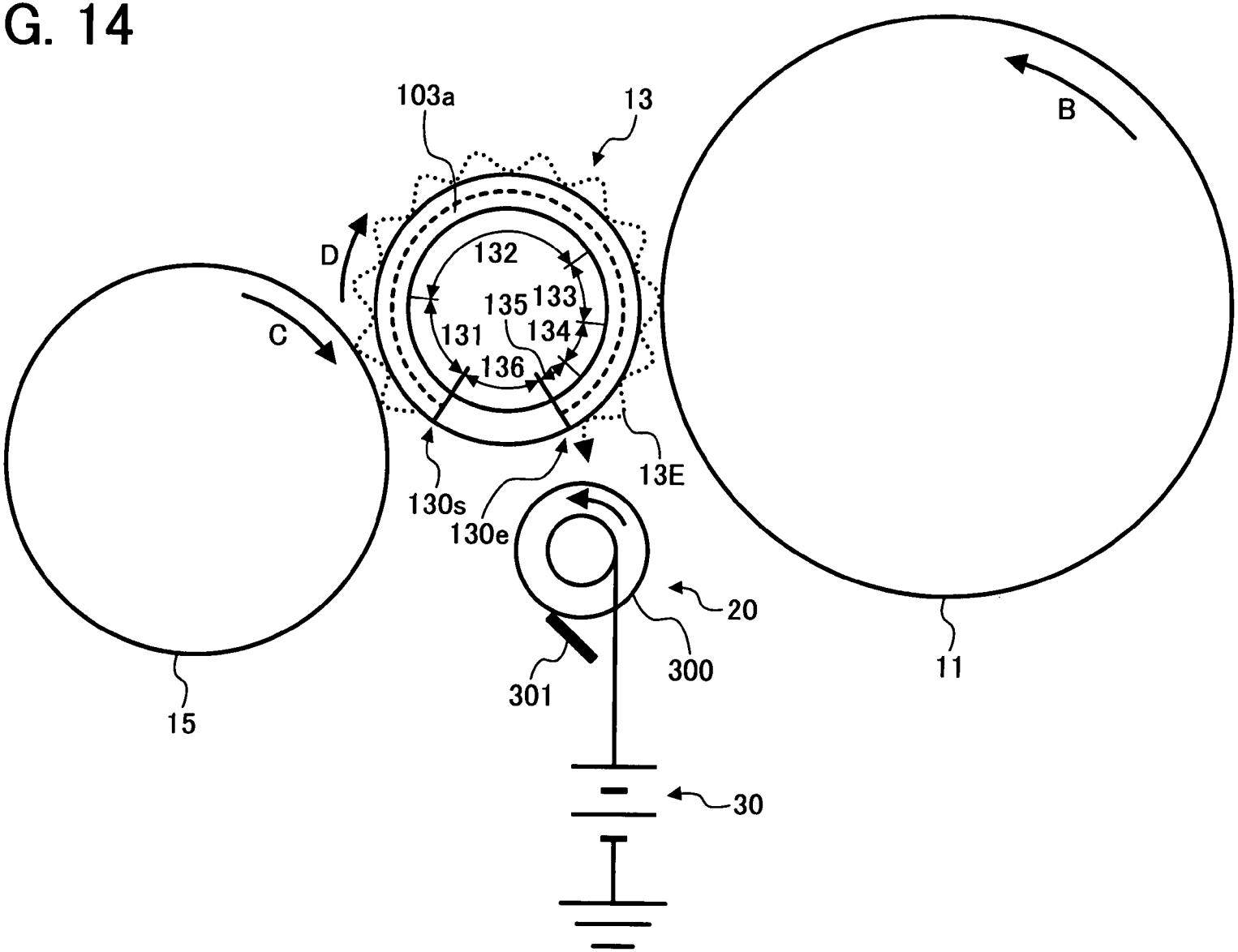
FIG. 14 is a diagram for explaining the electrostatic conveyance roller and the second example of the toner collection device more in detail.

FIG. 14 is a diagram for explaining the electrostatic conveyance roller 13 and the second example of the toner collection device 20 including the conductive roller 300 more in detail. As illustrated in FIG. 14, in the electrostatic conveyance roller 13, the supply area 131, the upstream side conveyance area 132, the development area 133, the downstream side conveyance area 134, and the collection area 135 are formed in the electric field area 130 sequentially in the toner conveyance direction. Toner particles supplied from the supply roller 15 in the supply area 131 are moved, passing the upstream side conveyance area 132, to the development area 133. Thereafter, the toner particles that did not contribute to development in the development area 133 passes the development area 133 and the downstream side conveyance area 134, and are moved to the collection area 135 or the conveyance electrode end part 130*e*.

The supply area 131, the upstream side conveyance area 132, the development area 133, the downstream side conveyance area 134, and the collection area 135 constitute the electric field area 130 generating the conveyance electric field 13E on their surfaces. However, strict boundaries do not necessarily exist between respective areas constituting the electric field area 130.

The toner particles conveyed to the conveyance electrode end part 130*e* of the electrostatic conveyance roller 13 in FIG. 13 cannot progress further because no conveyance electric field is generated beyond the conveyance electrode end part 130*e* as in the electrostatic conveyance roller 13 of FIG. 11, and the toner particles are caused to return in the opposite direction.

Thus, the toner particles repeat progressing and backing in the periphery of the conveyance electrode end part 130*e*, which is the boundary between the collection area 135 and the non-electric field area 136 as in the electrostatic conveyance roller 13 of FIG. 11. Therefore, by providing the conductive roller 300 in the periphery of the conveyance electrode end part 130*e*, the chance that the toner particles passed the development area 133 are caught by the collection electric field of the conductive roller 300 increases, so that collection of the toner particles is facilitated.

The conductive roller 300 may be constructed by a conductor made and adjusted to have the electric resistivity (volume resistivity) of $10\text{-}10^6$ Ω cm by compounding and dispersing a conducting property imparting agent, such as carbon black, zinc oxide, tin oxide, etc., in metal and resin material. The gap between the conductive roller 300 and the electrostatic conveyance roller 13 is in the range of 50-1000 μm, preferably in the range of 150-400 μm. The gap is preferably smaller than the height toner particles leap when the toner particles move on the electrostatic conveyance roller 13 by the phase-shifting electric field. In the development device 10 illustrated in FIG. 13, the gap is about 400 μm. By rotation of the conductive roller 300, the toner particles attracted to the conductive roller 300 are scraped off the conductive roller 300 by a removal blade 301 contacting the surface of the conductive roller 300, and the scraped toner particles fall in the development device 10 by gravity. Thereby, the part of the conductive roller 300 opposing the electrostatic conveyance roller 13 is always made clean so that a satisfactory collection electric field can be generated, and thereby, collection of the toner particles is performed more securely. The rotation direction of the conductive roller 300 is not particularly limited, however, is preferably the same direction as the toner conveyance direction.

As described above, in the first and the second examples of the toner collection device 20, toner particles moving on the electrostatic conveyance surface 103*a* of the electrostatic conveyance roller 13 are collected by a collection electric field, which is generated between the electrostatic conveyance roller 13 and the conductive member as the collection member of the toner collection device 20 by applying a collection voltage to the conductive member of the toner collection device 20. However, the toner collection device 20 is not limited to such devices using the collection electric field.

Figure 15:
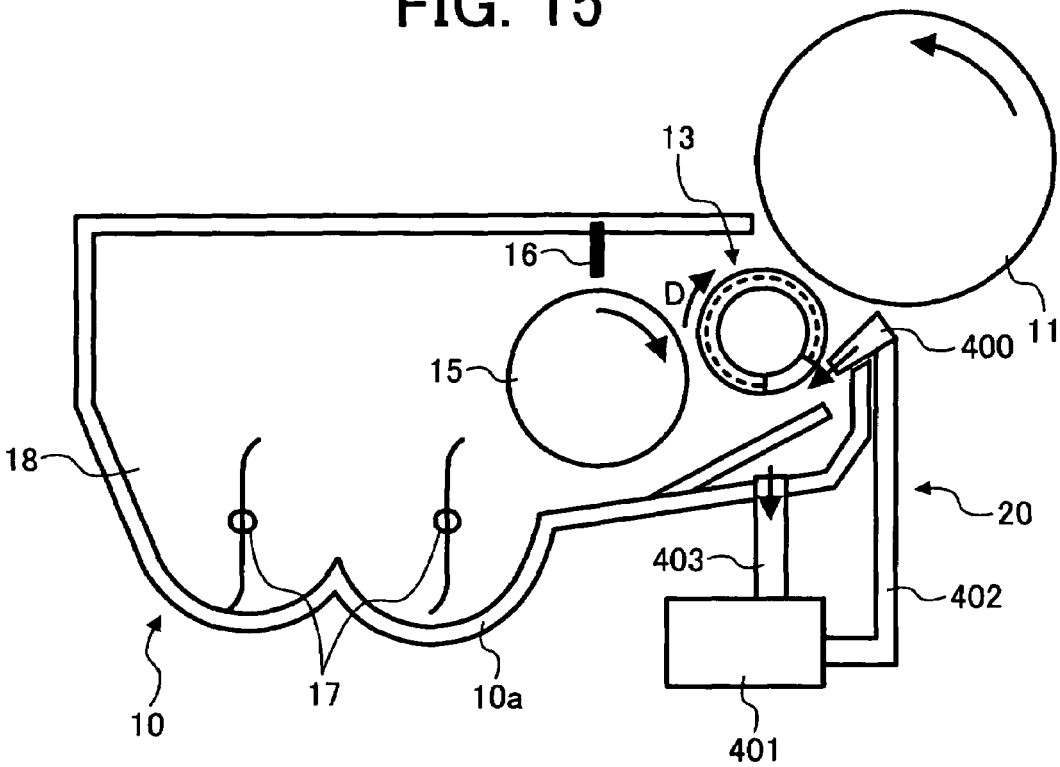
FIG. 15 is a diagram illustrating the photoconductor and the development device including the third example of the toner collection device.
Figure 16:
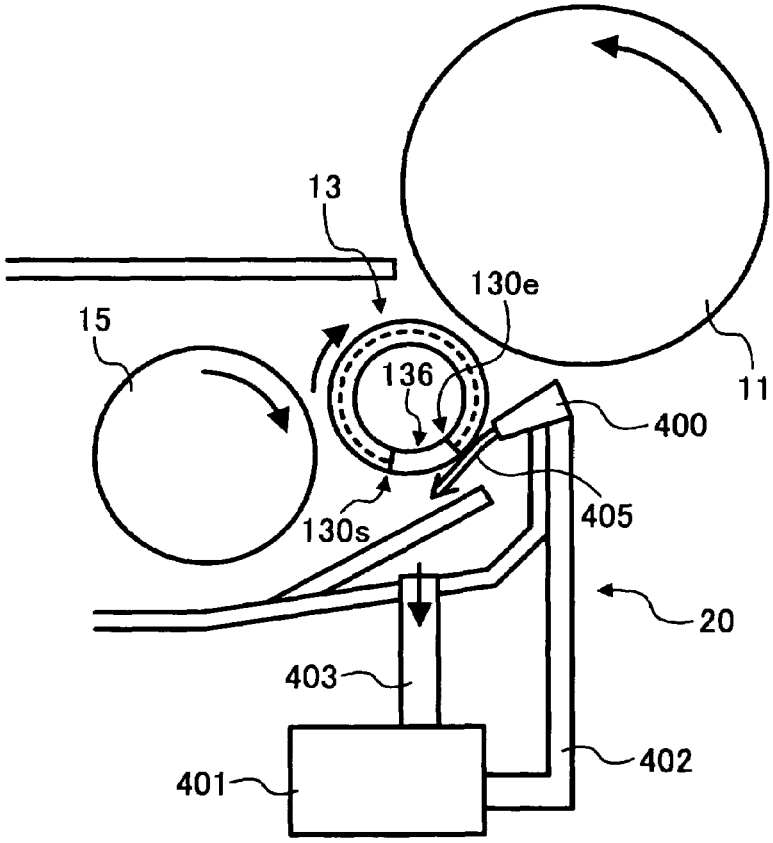
FIG. 16 is an enlarged diagram illustrating a part of the development device including the third example of the toner collection device and the photoconductor.

FIG. 15 is a diagram schematically illustrating the photoconductor 11, and the development device 10 including the third example of the toner collection device 20, which includes an airflow generation member and which collects toner particles on the electrostatic conveyance surface 103*a* of the electrostatic conveyance roller 13 by the force of airflow. FIG. 16 is an enlarged diagram illustrating a part of the development device 10 including the toner collection device 20 and the photoconductor 11.

The electrostatic conveyance roller 13 is divided into respective areas in substantially the same manner as described above with reference to FIG. 10 and FIG. 14. Therefore, the description thereof is omitted.

An air nozzle 400 as the airflow generation member is arranged such that the airflow is directed to the conveyance electrode start part 130*e* of the electrostatic conveyance roller 13. An exhaust opening of the air nozzle 400 is directed in the direction of the normal line of the surface of the electrostatic conveyance roller 13 such that the exhausted air flows along the surface of the electrostatic conveyance roller 13.

The toner particles that did not contribute to development in the development area of the electrostatic conveyance roller 13 passes the development area and is conveyed to the conveyance electrode end part 130*e*, where the toner particles are separated from the surface of the electrostatic conveyance roller 13 by the airflow exhausted from the air nozzle 400. The separated toner particles are collected into the developer accommodation part 18. The collected toner particles are stirred together with the developer in the developer accommodation part 18. It is preferable to constitute an air pump 401 for generating the airflow by a pump suitable for conveying powder (toner), such as a diaphragm pump. A fan, such as a sirocco fan, a cross flow fan, and a propeller fan, may be also used as long as measures are taken to avoid the motor from being affected by powder (toner).

The air flows along the surface of the electrostatic conveyance roller 13 from the upstream side of the conveyance electrode end part 130*e*, so that the toner particles are loosed from the conveyance electric field at the conveyance electrode end part 130*e*. The toner particles are blown to the non-electric field area 136 between the conveyance electrode end part 130*e* and the conveyance electrode start part 130*s*.

The part of the non-electric field area 136 of the electrostatic conveyance roller 13 is formed of an inorganic or organic insulating material. For the electrostatic conveyance roller 13, a roller made of insulating material, such as glass, resin, ceramic, etc., a roller made by forming an insulating film, such as $SiO_2$, etc., on a tube made of conductive material, such as SUS, and a roller made of flexible material, such as a polyimide film, etc., may be used.

Figure 17:
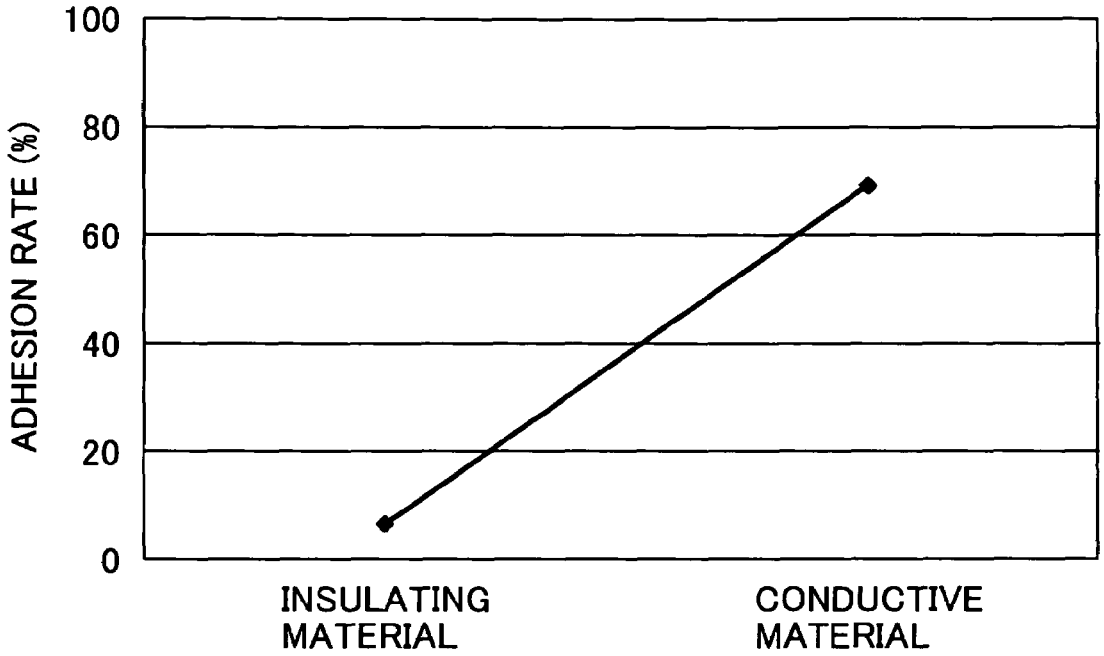
FIG. 17 is a diagram illustrating a graph comparing the deposit efficiencies of toner particles to a non-electric field area of the electrostatic conveyance roller when insulating material is used and when conductive material is used for the non-electric field area.

FIG. 17 is a diagram illustrating a graph comparing the adhesion rates of toner particles to the non-electric field area 136 when insulating material is used and when conductive material is used for the non-electric field area 136. As indicated in FIG. 17, by using insulating material for the non-electric field area 136, adhesion of the charged toner particles to the non-electric field area 136 is more surely prevented as compared with the case that conductive material is used, so that the toner particles can be securely released from the electrostatic conveyance roller 13.

The flow velocity of air at the opening of the air nozzle 400 is preferably equal to or greater than the toner conveyance speed. Here, the flow velocity of an airflow 405 of the air nozzle 400 is set to be 3 m/sec or greater, and the toner conveyance speed is 1 m/sec.

Figure 18:
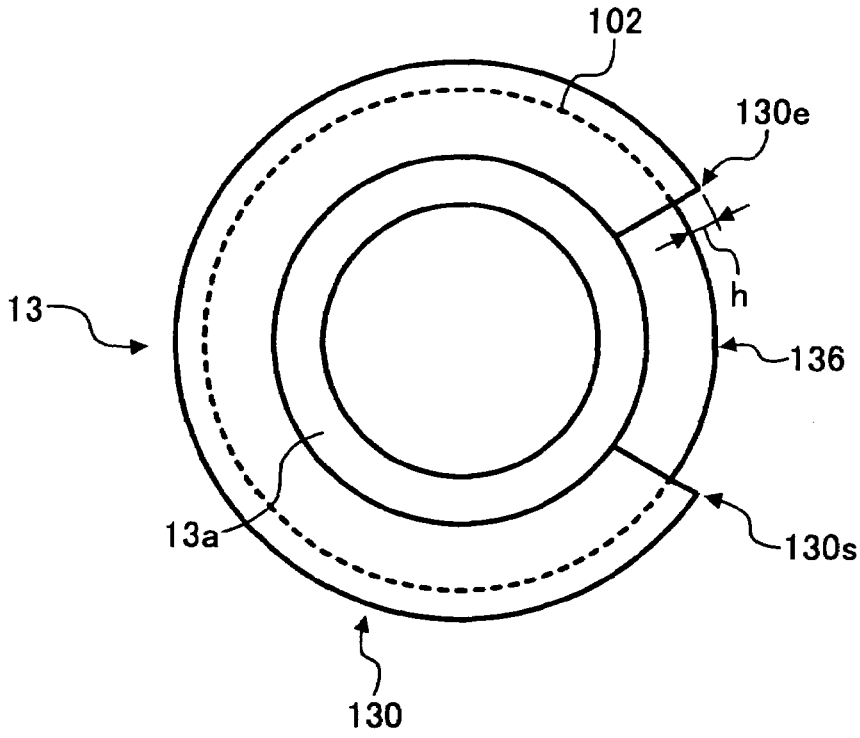
FIG. 18 is a diagram illustrating the electrostatic conveyance roller in which a step has been provided in the surface thereof.

The surface of the non-electric field area 136 pf the electrostatic roller 13 may be made lower that than of the electric field area 130 by providing a step "h" at the conveyance electrode end part 130*e* as illustrated in FIG. 18. In figure, reference numeral 13*a* denotes a tube of the electrostatic conveyance roller 13.

Figure 19:
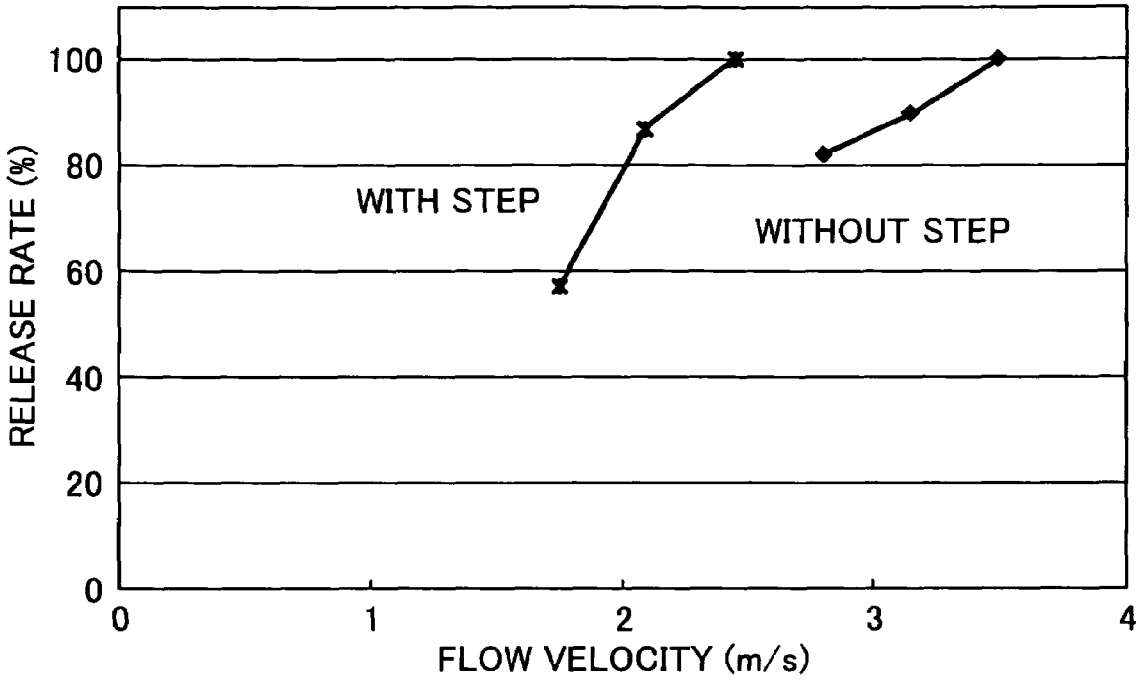
FIG. 19 is a diagram illustrating a graph indicating an experiment result of measuring the flow velocities of airflow and the release efficiencies of toner particles when the step is provided and when the step is not provided in the surface of the electrostatic conveyance roller.

FIG. 19 is a diagram of a graph indicating an experiment result of measuring the flow velocities of the airflow 405 and the release rates of toner particles when the step h is provided and when the step h is not provided.

As indicated in FIG. 19, by providing the step h at the conveyance electrode end part 130*e* so that the surface of the non-electric field area 136 is lower than that of the electric field area 130, the flow velocity can be suppressed to about 2 m/sec.

Because the pressure inside of the development device 10 is increased by the airflow 405, the flow velocity of the airflow 405 is preferably as low as possible. Further, an inlet 403 of the air pump 401 used for generating the airflow 405 is preferably placed at the place where the pressure inside of the development device 10 increases and where toner particles are not directly sucked. Thereby, the air circulates within the development device 10 and the pressure increase within the development device 10 is suppressed.

Figure 20:
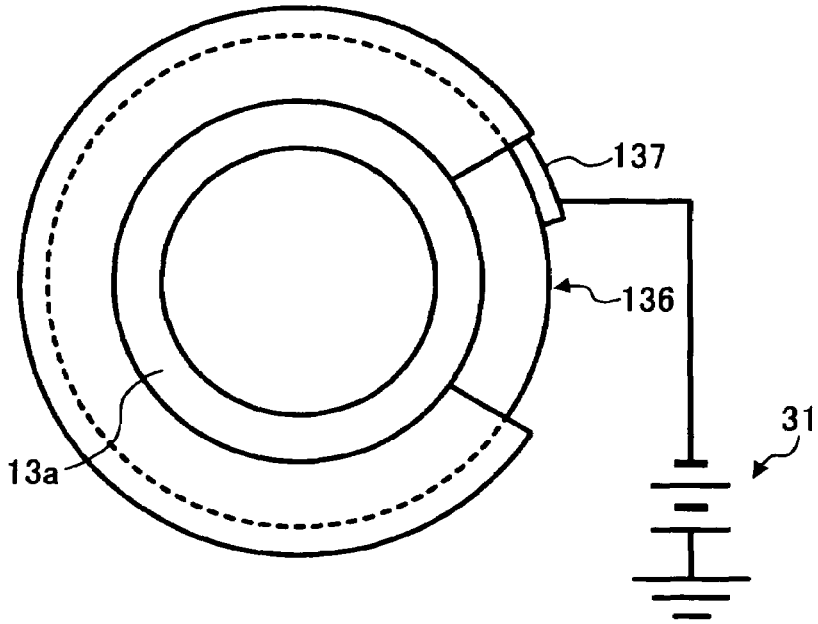
FIG. 20 is a diagram of the electrostatic conveyance roller in which a toner repulsive electrode plate has been arranged on the insulating member constituting the non-electric field area.

Further, as illustrated in FIG. 20, a toner repulsive electrode plate 137 may be arranged on the insulating member constituting the non-electric field area 136, to which bias voltage of the polarity opposite to that of the toner particles is applied. The tube 13*a* of the electrostatic conveyance roller 13 and the toner repulsive electrode plate 137 are preferably formed by non-magnetic material such as aluminum, brass, stainless, conductive resin, etc. Thereby, influence of the magnetic field of the supply roller 15 and adhesion of magnetic carriers can be avoided.

As described above, by providing the toner collection device 20 to collect the toner particles in the vicinity of the conveyance electrode end part 130*e* as the downstream side end of the electric conveyance surface 103*a* of the electrostatic conveyance roller 13 as the electrostatic conveyance device, the toner particles passed the development area 133 of the electrostatic conveyance roller 13 can be reliably collected. Accordingly, variation in the quantity of toner particles on the electrostatic conveyance roller 13, which is caused by that the toner particles passed the development area 133 reaches the supply area 131, can be suppressed, so that occurrence of uneven development is suppressed and stable development can be performed.

In the above-described embodiment, the toner conveyance speed in the electric field area 130 generating the conveyance electric field is constant, however, the toner conveyance speed may be made slower in the collection area of the electric field area 130.

Figure 21:
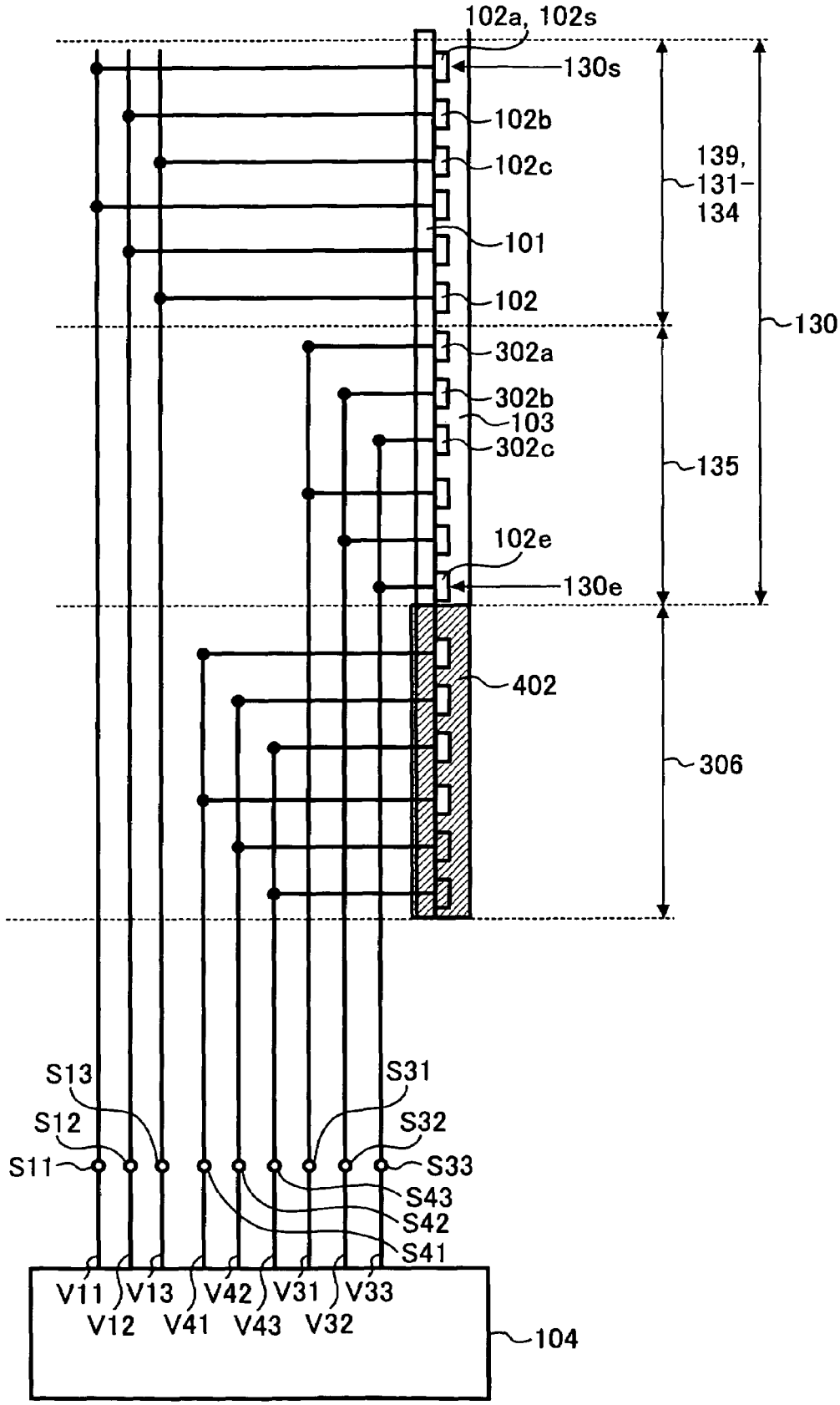
FIG. 21 is a schematic diagram for explaining the arrangement of the plurality of electrodes of the electrostatic conveyance roller configured such that the toner conveyance speed is slower in a collection area of the electrostatic conveyance roller.

FIG. 21 is a schematic diagram for explaining the arrangement of the plurality of electrodes 102 of the electrostatic conveyance roller 13 configured such that the toner conveyance speed is slower in the collection area 135.

The electrostatic conveyance roller 13 includes a plurality of electrode areas generating electric fields for supplying toner particles, moving the toner particles, causing the toner particles to adhere to a latent image, and collecting the toner particles passed the development area, as in the previous embodiment. Here, description will be made with respect to the case that 3-phase drive voltage is applied to the electrostatic conveyance roller 13, however, the present invention can be applied to any case that n-phase drive voltage, "n" being an arbitrary natural number satisfying the condition of n>2, is applied to the electrostatic conveyance roller 13 as long as toner particles are moved on the electrostatic conveyance roller 13.

Each electrode 102 is connected with the first connection point S11, the second connection point S12, the third connection point S13, a first collection connection point S31, a second collection connection point S32, or a third collection connection point S13. In the state that the development device 10 has been installed to the main body of the printer 100, respective connection points are connected with the power source 104 of the main body applying the first drive waveform V11, the second drive waveform V12, the third drive waveform V13, a first collection drive waveform V31, a second collection drive waveform V32, and a third collection drive waveform V33.

The electrostatic conveyance roller 13 is divided into the electric field area 130 and the non-electric field area 136 as described above referring to FIG. 10. Further, the electric field area 130 is divided into the supply area 131 where toner particles are supplied by the supply roller 15, the upstream side conveyance area 132 where the toner particles are moved to the vicinity of the photoconductor 11, the development area 133 where the toner particles are caused to adhere to a latent image on the photoconductor 11 to form a toner image, the downstream side conveyance area 134 where the toner particles passed the development area 133 without contributing to development are moved, and the collection area 135 where the toner particles passed the development area 133 without contributing to development are collected.

The supply area 131 is the area close to the supply main pole P1 of the supply roller 15, the upstream side conveyance area 132 exists between the supply area 131 and the development area 133, and the development area 133 exists in the area close to the photoconductor 11. The downstream side conveyance area 134 exists between the development area 133 and the collection area 135. The collection area 135 is the area close to the collection pole P2 of the supply roller 15.

Here, the area including the supply area 131, the upstream side conveyance area 132, the development area 133, and the downstream side conveyance area 135 is denoted as a regular conveyance area 139. In the regular conveyance area 139, the first drive waveform V11 is applied to the first electrode 102*a*, the second drive waveform V12 is applied to the second electrode 102*b*, the third drive waveform V13 is applied to the third electrode 102*c*, and the drive frequency is between 2 KHz and 8 kHz. It is preferable that bias voltages having drive waveforms different from those applied in other areas of the regular conveyance area 139 are applied in the development area 133 as described above with respect to the previous embodiment, however, description thereof is omitted.

In the collection area 135, the first collection drive waveform V31 is applied to a first collection electrode 302*a*, the second collection drive waveform V32 is applied to a second collection electrode 302*b*, and the third collection waveform V33 is applied to a third collection electrode 302*c*. The drive frequency is set to be lower than that in the regular conveyance area 139. Here, the drive frequency of the regular conveyance area 139 is 5 kHz and that of the collection area 135 is 3 kHz.

Figure 22:
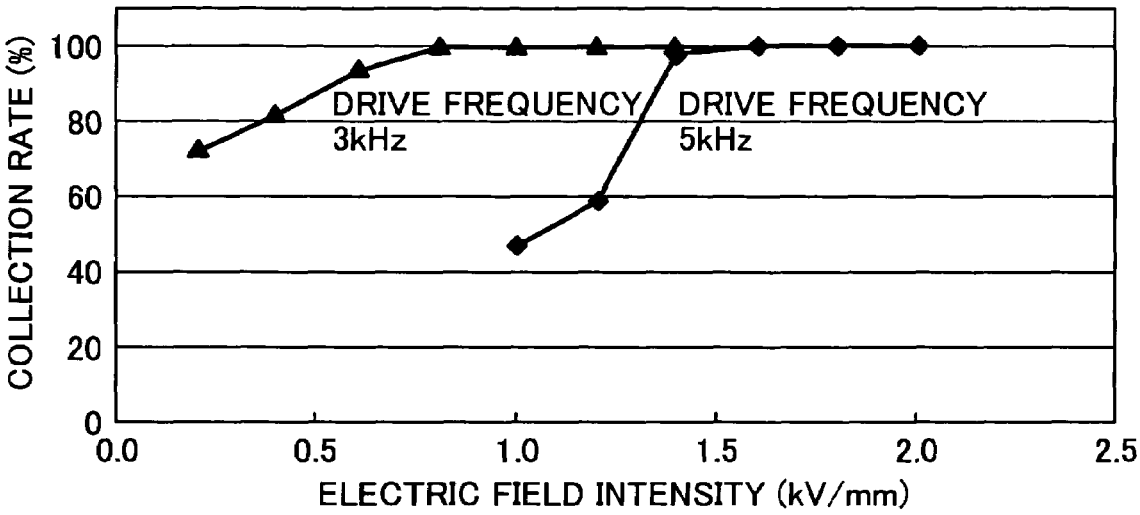
FIG. 22 is a diagram illustrating a graph indicating a result of an experiment 2 measuring the intensities of the electric field and the collection efficiencies when the drive frequency applied to collection electrodes of the collection area is 3 kHz and when the drive frequency is 5 kHz.

To confirm the difference in the collection efficiency due to the difference in the drive frequency, an experiment 2 has been performed to measure the intensities of the electric field and the collection rates when the drive frequency applied to the collection electrodes 302 of the collection area 135 is 3 kHz and when the drive frequency is 5 kHz, and FIG. 22 is a diagram of a graph indicating the result of the experiment 2.

As illustrated in FIG. 22, by setting the drive frequency to 3 kHz, the electric field intensity necessary for performing collection can be made lower as compared when the drive frequency is 5 kHz.

In the experiment 2, the supply bias voltage applied to the supply roller 15 is −400V, the charge voltage applied to the charge roller 12 is −140V, and the voltage applied to the photoconductor 11 after exposure is −40V. Drive pulse signals of 1100V (the average value being −100V) are applied to the drive waveforms V11, V12, and V13 of the power source 104 connected with respective electrodes 102 of the regular conveyance area 139. On the other hand, drive pulse signals of ±100V (the average value being −500V) are applied to drive waveforms V31, V32, and V33 of the power source 104 connected with respective collection electrodes 102 of the collection area 135 to collect toner particles.

Further, in the electrostatic conveyance roller 13 in the above-described embodiment, an electrode is not provided in the non-electric field area 136. However, as illustrated in FIG. 21, non-electric electrodes 402 may be provided in the non-electric field area 136. The non-electric electrodes 402 are connected with non-electric electric field connection points S41, S42, and S43, which are connected with the power source 104 of the main body generating non-electric field area drive waveforms V41, V42, and V43. The non-electric field area drive waveforms V41, V42, and V43 are applied when development is not performed, so that toner particles on the electrostatic conveyance roller 13 are continuously moved to return to the supply area by the phase-shifting electric field.

Thus, by causing the non-electric field area 136 to function as a second electrostatic conveyance surface, when development is not performed, the toner particles are kept moving on the electrostatic conveyance roller 13, so that unnecessary collection and supplying of the toner particles is not performed and thereby deterioration of the toner particles can be suppressed.

Figure 23:
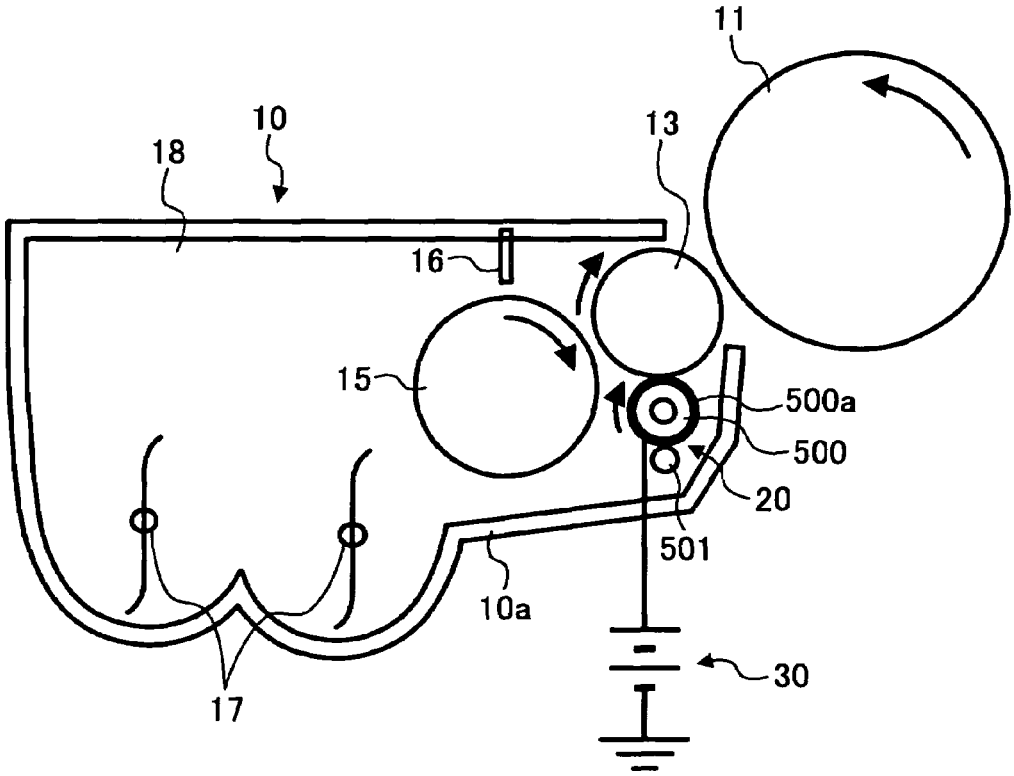
FIG. 23 is a diagram for explaining the fourth example of the toner collection device.

FIG. 23 is a diagram for explaining the fourth example of the toner collection device 20. The fourth example of the toner collection device 20 includes a brush roller 500 as the collection member. A brush 500*a* formed by a thin fiber is provided to the outer circumferential surface of the brush roller 500. By charging the brush 500*a* by rotating the brush roller 500 at a high speed or by applying bias voltage of the polarity opposite to that of toner particles to the brush roller 500, the toner particles on the electrostatic conveyance roller 13 are caused to adhere to the brush 500*a*, and thereby the toner particles are separated from the electrostatic conveyance roller 13. The polarity of the bias voltage applied to the brush roller 500 is opposite to that of the bias voltage applied to the electrostatic conveyance roller 13. Here, the bias voltage in the range from 0V to +100V is applied to the brush roller 500.

Further, a bar 501 is arranged so as to contact the tip ends of the brush 500*a* of the brush roller 500. With rotation of the brush roller 500, toner particles adhering to the tip ends of the brush 500*a* come into collision with the bar 501 and are scraped off the brush 500*a* by the bar 501. A biased roller may be arranged, instead of the bar 501, to contact the tip ends of the brush 500*a* to electrostatically separate the toner particles from the brush 500*a*.

The toner particles scraped off the brush 500*a* are collected into the development casing 10*a*. The rotation direction of the brush roller 500 is not limited in particular, however, is preferably the opposite of the toner conveying direction by the electrostatic conveyance roller 13.

The toner particles collected into the development casing 10*a* are caught again by the developer born on the supply roller 15, and are conveyed to be supplied to the electrostatic conveyance roller 13.

As described above, by providing a rotation member rotating in contact with the electrostatic conveyance surface 103*a* of the electrostatic conveyance roller 13, toner particles on the electrostatic conveyance surface 103*a* can be mechanically separated relatively easily to be collected.

Figure 24:
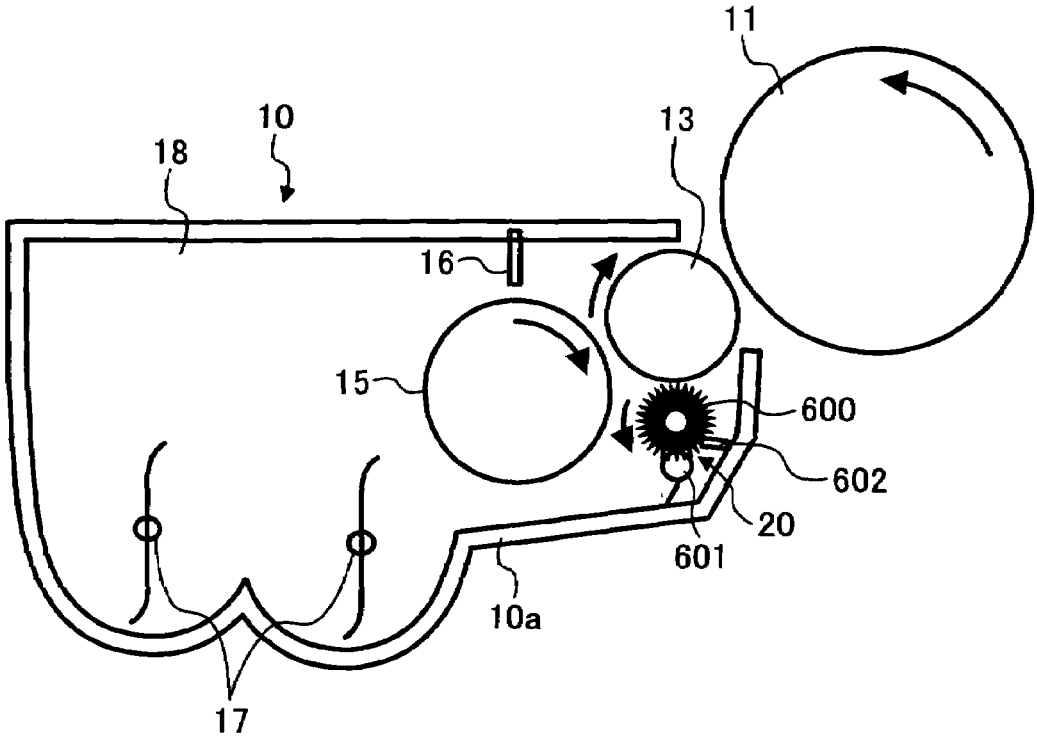
FIG. 24 is a diagram for explaining the fifth example of the toner collection device.

FIG. 24 is a diagram for explaining the fifth example of the toner collection device 20.

The fifth example of the toner collection device 20 includes a magnetic brush roller 600 as the collection member. The magnetic brush roller 600 includes internal magnets generating magnetic lines and is configured to form a brush of magnetic carriers on the circumferential surface of a sleeve thereof. The magnetic brush roller 600 is arranged to oppose the electrostatic conveyance roller 13 between the development area and the supply area of the electrostatic conveyance roller 13. The magnetic carriers of the magnetic brush roller 600 are supplied from the supply roller 15 at the part of the magnetic brush roller 600 close to the supply roller 15. Bias voltage of the polarity opposite that of the toner particles is applied to the sleeve of the magnetic brush roller 600 by a bias power source (not shown).

Tip ends of the ears of the magnetic brush on the magnetic brush roller 600 are regulated by a doctor blade 602 so that the tip ends of the ears of the magnetic brush uniformly contact the surface of the electrostatic conveyance roller 13. Further, a collection roller 601 is provided to separate and collect the toner particles from the magnetic brush. Bias voltage is applied to the collection roller 601 by a bias power source (not shown).

The toner particles moving on the electrostatic conveyance surface 103*a* of the electrostatic conveyance roller 13 and passed the development area of the electrostatic conveyance roller 13 without contributing to development are caught by magnetic carriers of the magnetic brush roller 600. The toner particles are further caught by the collection roller 601 and are collected into the development casing 10*a*.

The collected toner particles are caught again by the developer born on the supply roller 15 and are conveyed to the supply area to be supplied to the electrostatic conveyance roller 13.

As described above, by providing a magnetic brush roller rotating and forming a brush with magnetic carriers to oppose the electrostatic conveyance surface 103*a* of the electrostatic conveyance roller 13, the toner particles can be electrostatically collected from the electrostatic conveyance surface 103*a* of the electrostatic roller 13.

The quantity of toner particles caught by the brush roller 500 or the magnetic brush roller 600 is greater as the probability that the brush roller 500 or the magnetic brush roller 600 contacts or comes close to the surface of the electrostatic conveyance roller 13 is higher. Therefore, by setting the rotation speeds of the brush roller 500 and the magnetic brush roller 600 faster than the toner conveyance speed of the electrostatic conveyance roller 13, the toner particles can be efficiently collected from the electrostatic conveyance roller 13.

Figure 25:
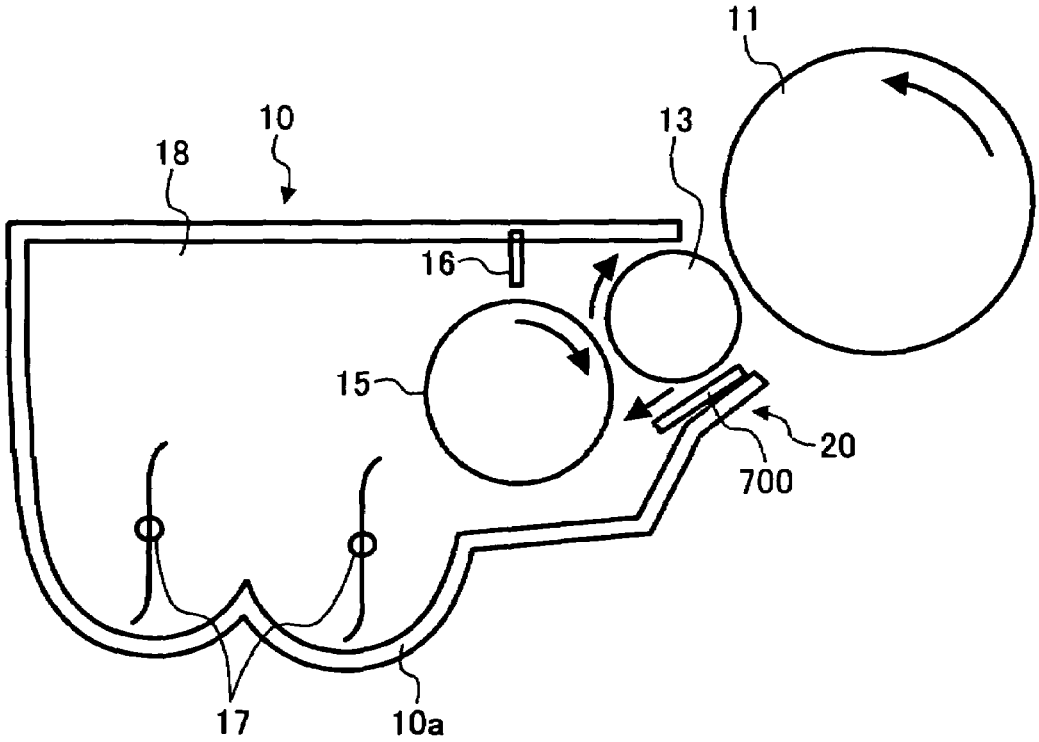
FIG. 25 is a diagram for explaining the sixth example of the toner collection device.

FIG. 25 is a diagram for explaining the sixth example of the toner collection device 20. The sixth example of the toner collection device 20 is constituted of a collection electrostatic conveyance plate 700 having a plurality of electrodes for generating a phase-shifting electric field to move toner particles. The electrostatic conveyance plate 700 is arranged to oppose the electrostatic conveyance roller 13 between the development area and the supply area of the electrostatic conveyance roller 13.

When the average value of drive voltages for the electrostatic conveyance roller 13 is −100V, by making the average value of drive voltages for the collection electrostatic conveyance plate 700 to 0V, the toner particles are caused to move from the electrostatic conveyance roller 13 to the collection electrostatic conveyance plate 700. The toner particles passed the development area of the electrostatic conveyance roller 13 without contributing to development are caught by the phase-shifting electric field of the collection electrostatic conveyance plate 700. The toner particles are moved by the collection electrostatic conveyance plate 700 and are collected into the development casing 10*a*. The pulses of the drive voltages for the electrostatic conveyance roller 13 and the collection electrostatic conveyance plate 700 are synchronized with each other.

The toner particles collected by the collection electrostatic conveyance plate 700 are caught again by the developer of the supply roller 15 and are conveyed to the supply area to be supplied to the electrostatic conveyance roller 13.

By configuring the toner collection device 20 by the electrostatic conveyance plate 700 arranged to oppose the electrostatic conveyance surface 103*a* of the electrostatic conveyance roller 13, the toner collection device 20 is made relatively compact.

Figure 26:
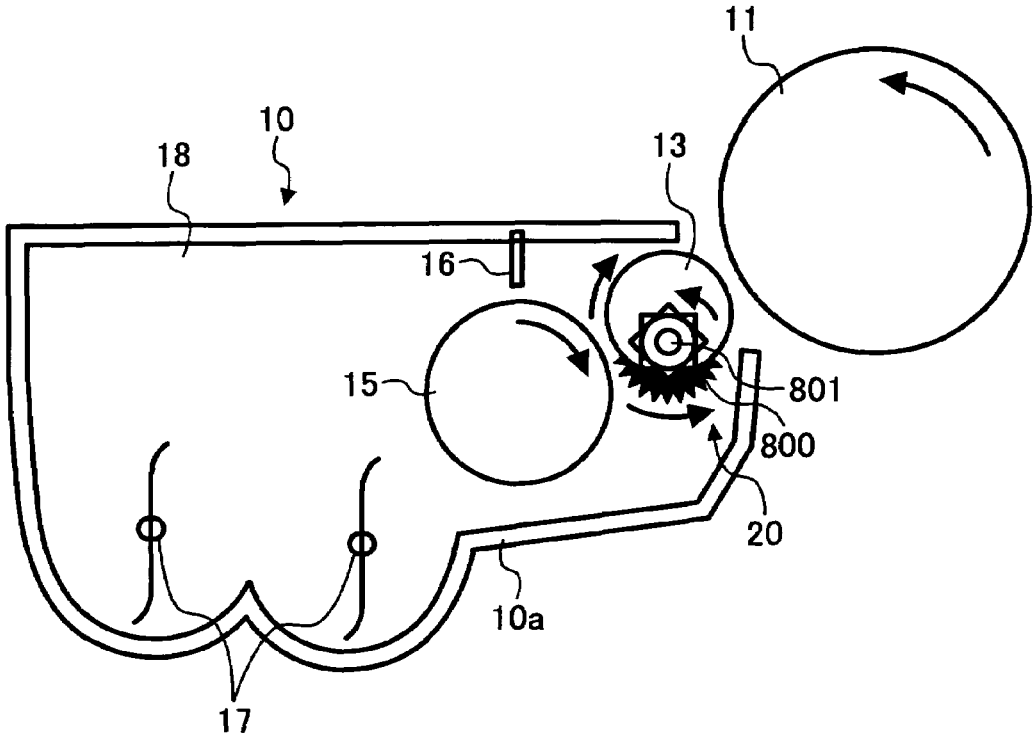
FIG. 26 is a diagram for explaining the seventh example of the toner collection device.

FIG. 26 is a diagram for explaining the seventh example of the toner collection device 20. The seventh example of the toner collection device 20 is constituted of a magnet roller 801 included inside of the electrostatic conveyance roller 13 and a magnetic brush 800 of magnetic carriers formed on the circumferential surface of the electrostatic conveyance roller 13 between the development area and the supply area thereof by magnetic lines of the magnet roller 801. The magnetic carriers forming the magnetic brush 800 are supplied from the supply roller 15 to the part of the electrostatic conveyance roller 13 opposing the supply roller 15.

The toner particles passed the development area of the electrostatic conveyance roller 13 without contributing to development are caught by the magnetic carriers of the magnetic brush 800 on the surface of the electrostatic conveyance roller 13. By rotation of the magnetic roller 801 in the counterclockwise direction in figure, the magnetic force on the surface of the electrostatic conveyance roller 13 is lost, so that the magnetic carriers of the magnetic brush 800 and the toner particles caught by the magnetic carriers fall and are collected in the development casing 10*a*.

The collected toner particles are caught again by the developer of the supply roller 15, and are conveyed to the supply area to be supplied to the electrostatic conveyance roller 13.

As described above, by configuring the toner collection device 20 by a magnetic brush of magnetic carriers formed on the electrostatic conveyance surface 103*a* of the electrostatic conveyance roller 13 by a magnet roller provided inside of the electrostatic conveyance roller 13, the toner particles can be collected from the electrostatic conveyance surface 103*a* of the electrostatic conveyance roller 13. Further, because the magnet roller generating the magnet brush is included inside of the electrostatic conveyance roller 13, the toner collection device 20 is made relatively compact.

Figure 27:
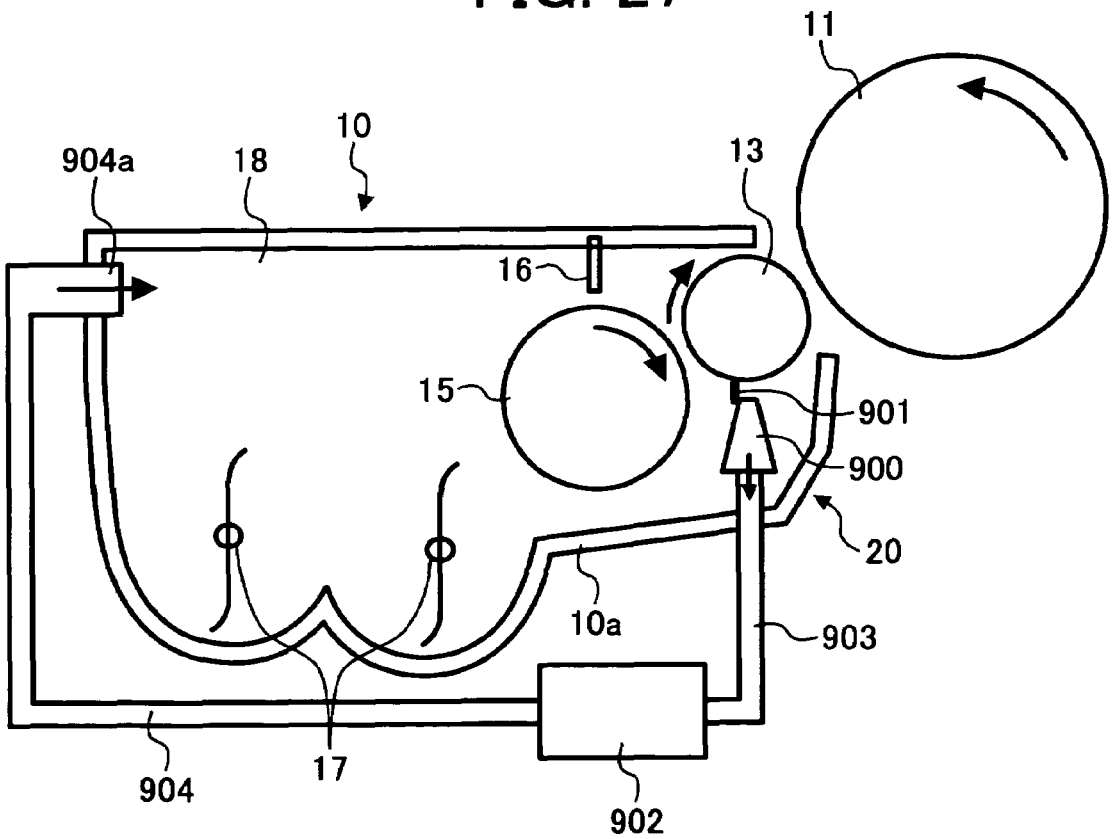
FIG. 27 is a diagram for explaining the eighth example of the toner collection device.

FIG. 27 is a diagram for explaining the eighth example of the toner collection device 20.

The eighth example of the toner collection device 20 includes a suction nozzle 900 arranged to oppose the development area of the electrostatic conveyance roller 13 between the development area and the supply area thereof. The gap between the surface of the electrostatic conveyance roller 13 and an opening part of the suction nozzle 900 is preferably in the range of 150-400 μm and is high as the height toner particles leap when the toner particles are moved on the electrostatic conveyance roller 13 by the phase-shifting electric field. Here, the gap is about 500 μm.

Further, a seal member 901 is provided at one end of the opening of the suction nozzle 900 to stop the toner particles moving on the electrostatic conveyance roller 13 to be easily sucked by the suction nozzle 900. Furthermore, a suction pump 902 is connected with the suction nozzle 900 via a duct 903, and the sucked toner particles are discharged into the development casing 10*a* through an outlet 904*a* of a duct 904. A pump capable of conveying powder, such as a diaphragm pump and a Monoe-pump, is used for the suction pump 902. The flow velocity at the opening of the suction nozzle 900 is preferably equal to or greater than the toner conveyance speed. Here, the flow velocity of the suction nozzle 900 is set to 2 m/sec whereas the toner conveyance speed is 1 m/se.

The toner particles passed the development area of the electrostatic conveyance roller 13 are sucked by the suction nozzle 900, are conveyed by the suction pump 902 through the ducts 903 and 904, and are collected into the toner accommodation part 18 of the development device 10. The collected toner particles are stirred together with the developer in the toner accommodation part 18 and are supplied to the supply roller 15.

As described above, by proving a nozzle for sucking toner particles in the vicinity of the electrostatic conveyance surface 103*a* of the electrostatic conveyance roller 13, the toner particles can be easily separated from the electrostatic conveyance surface 103*a* of the electrostatic conveyance roller 13 and collected to an arbitrary place.

Figure 28:
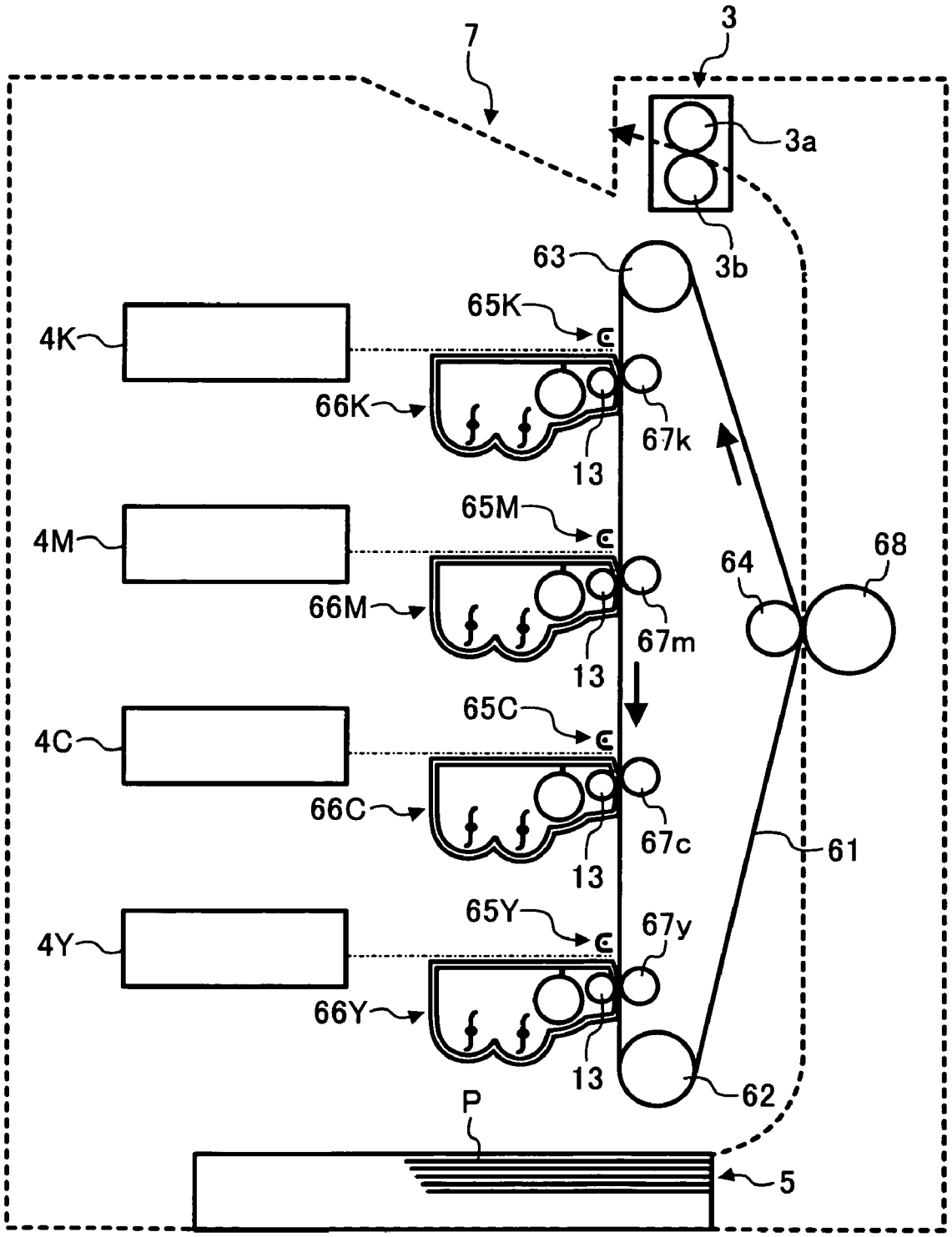
FIG. 28 is a diagram schematically illustrating a color image forming apparatus including a development device according to another embodiment of the present invention.

FIG. 28 schematically illustrates a color image forming apparatus including a development device according to another embodiment of the present invention.

The image forming apparatus includes an image bearing member 61 constituted of a negatively charging organic member formed in a belt shape. The image bearing member 61 is spanned around a drive roller 62, a driven roller 63, and a transfer opposing roller 64, and is rotated in the direction of an arrow in figure by a rotation drive mechanism (not shown).

Charge devices 65K, 65M, 65C, and 65Y charging the image bearing member 61, and development devices 66K, 66M, 66C, and 66Y of the present invention, developing electrostatic latent images on the image bearing member 61, are arranged to oppose the image bearing member 61 so that as the image bearing member 61 moves, toner images of respective colors are sequentially formed on the image bearing member 61 while being overlapped on top of another.

Further, opposing roller 67*k*, 67*m*, 67*c*, and 67*y* are arranged to oppose electrostatic conveyance rollers 13 of the development devices 66K, 66M, 66C, 66Y while sandwiching the image bearing member 61, and a transfer roller 68 is arranged to oppose the transfer opposing roller 64 while sandwiching the image bearing member 61.

When forming an image, a transfer sheet P fed from a feed device 5 is conveyed to a nip part of the image bearing member 61 and the transfer roller 68, where a full color image formed on the image bearing member 61 is transferred onto the transfer sheet P by voltage applied to the transfer roller 68. Thereafter, the transfer sheet P reaches a fixing device 3, where the full color image is fixed to the transfer sheet P by being sandwiched between and heated by a heating roller 3*a* and a pressing roller 3*b*, and thereby a full color image is obtained on the transfer sheet P.

Figure 29:
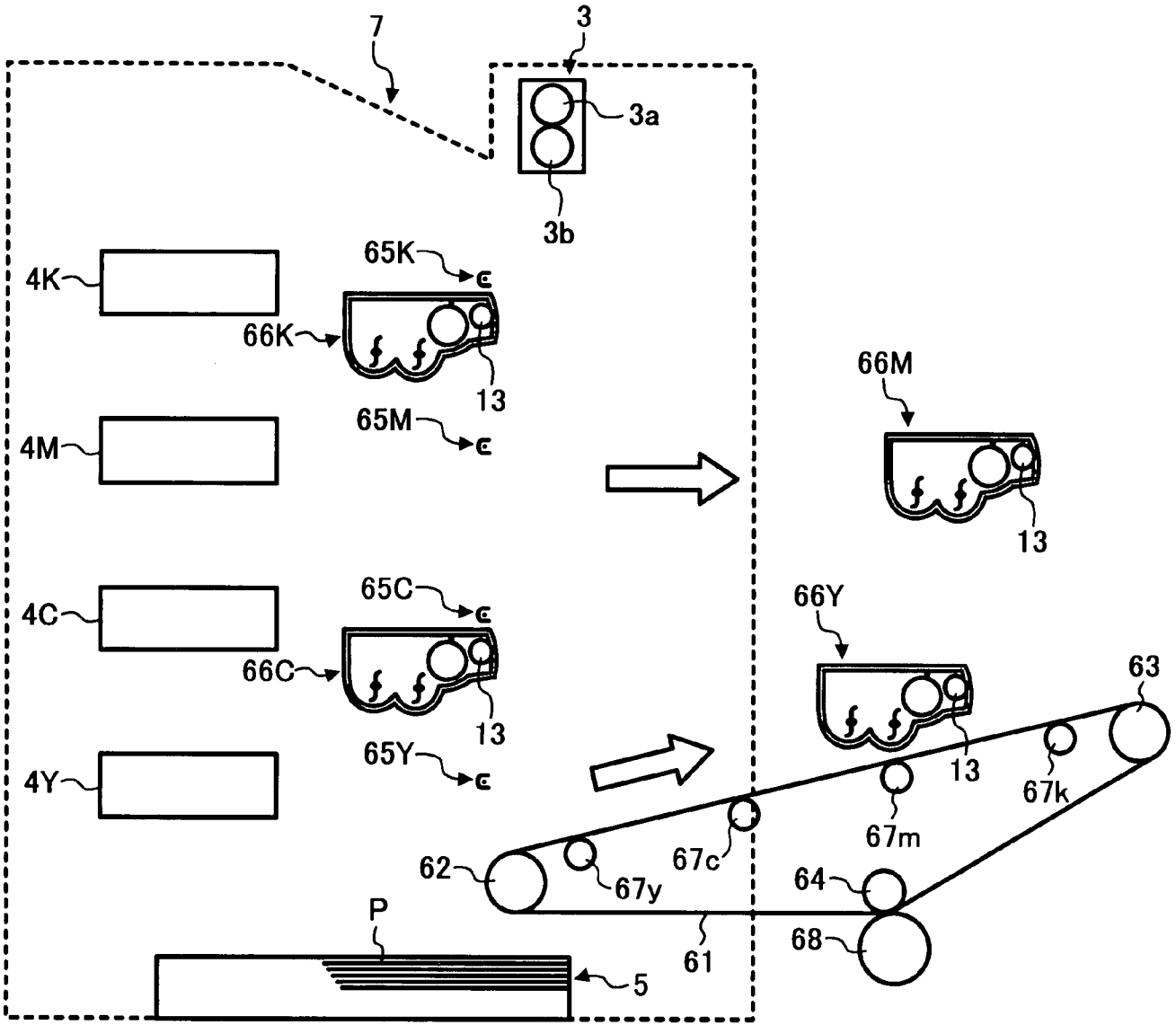
FIG. 29 is a diagram for explaining that the development device of the image forming apparatus of FIG. 28 is detachable from the main body thereof.

Here, as illustrated in FIG. 29, the image forming apparatus is configured such that by causing the image bearing member 61 to retreat from the main body of the image forming apparatus, the development devices 66K, 66M, 66C, and 66Y are detachable from the main body of the image forming apparatus, for example, for replacement.

Figure 30:
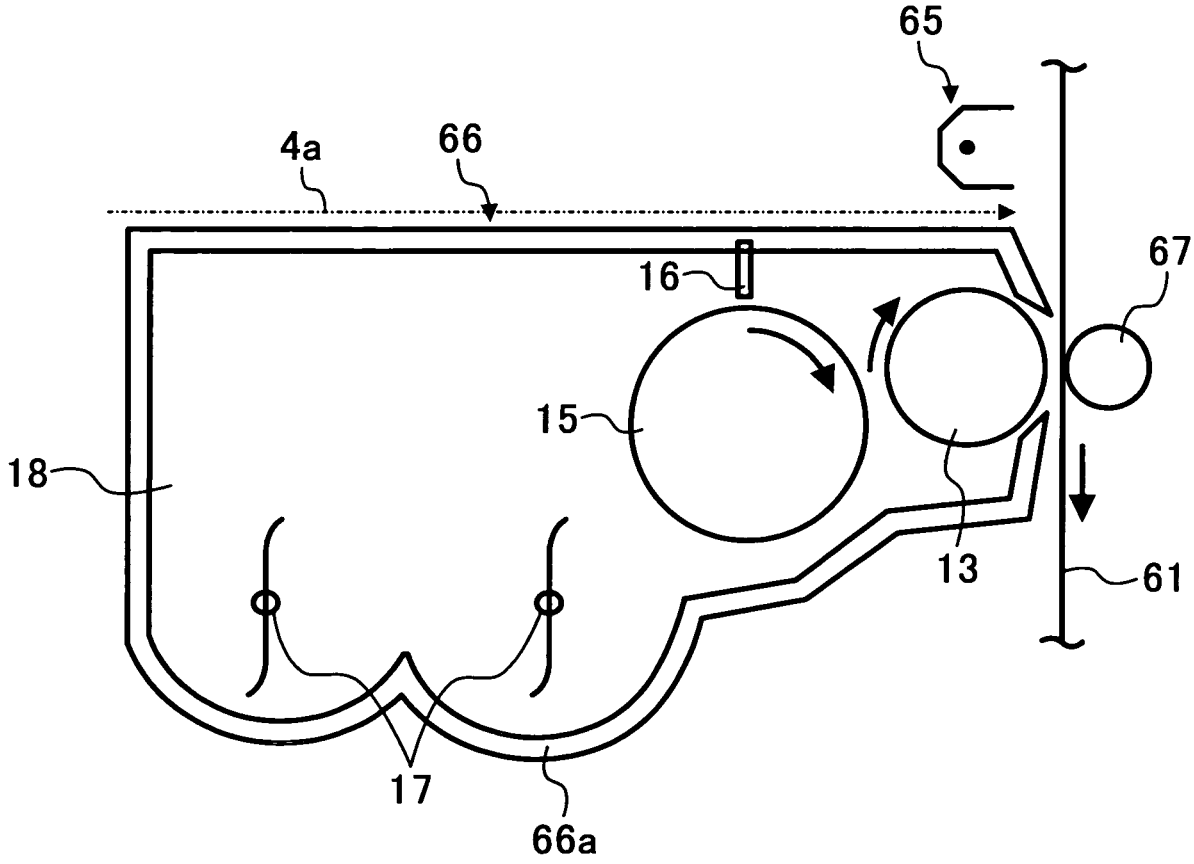
FIG. 30 is a diagram for explaining respective elements relating to charging and development of the image forming apparatus of FIG. 28.

FIG. 30 is a diagram for explaining respective elements relating to charging and development of the image forming apparatus. The charge device 65 uniformly charges the surface of the image bearing member 61. A corona charge device is used for the charge device 65. By using a non-contact type charge device, such as the corona charge device, the image bearing member 61 can be charged without disturbing the toner image formed thereon by the development device 66 at the upstream side.

When forming a toner image on the image bearing member 61, first, the surface of the image bearing member 61 is uniformly charged by the charge device 65. Even when a previous toner image has been formed on the image bearing member 61, the surface of the image bearing member 61 including the toner image thereon is uniformly charged. Then, an optical beam 4*a* according to image information is illuminated onto the image bearing member 61 by an optical writing device 4 (FIG. 28). The optical beam 4*a* passes between the charge device 65 and the development device 66 and illuminates the uniformly charged surface of the image bearing member 61, so that the area corresponding to an image part on the surface of the image bearing member 61 is discharged, and thereby a latent image is formed.

The development device 66 causes toner particles to adhere to the latent image formed on the image bearing member 61 and thereby the latent image is visualized as a toner image as in the previous embodiment. The above-described charging, illuminating of an optical beam, and developing are repeated at respective parts where the development devices 66 oppose the image bearing member 61, and thereby a full color image in which toner images of four colors have been superimposed is formed on the image bearing member 61.

In the image forming apparatus of this embodiment, a cleaning device for collecting residual toner particles remaining on the surface of the image bearing member 61 is not provided. The toner particles remaining on the surface of the image bearing member 61 are kept on the surface of the image bearing member 61, however, are charged by the charge devices 65, so that the residual toner particles are subsequently transferred to the transfer sheet P. When such residual toner particles are transferred to the transfer sheet P, an image on the transfer sheet P might be slightly disturbed, which, however, is not visually recognizable.

In the development device 66, a supply roller 15 is provided to supply toner particles to an electrostatic conveyance roller 13. A magnetic brush is formed at the part of the supply roller 15 opposing the electrostatic conveyance roller 13. A non-magnetic sleeve is formed by a non-magnetic member, such as aluminum, brass, stainless, conductive resin, etc., on the surface of the supply roller 15, and the sleeve is rotated in the direction indicated by an arrow in figure by a rotation mechanism (not shown).

A doctor blade 16 is provided to regulate the quantity of developer including the toner particles on the sleeve of the supply roller 15. A developer accommodation part 18 accommodates developer, and two screws 17 are arranged in the developer accommodation part 18 to stir and scoop up the developer onto the supply roller 15.

A magnet roller is fixedly provided inside of the supply roller 15, and the magnetic roller forms a magnetic field to cause the developer to rise like ears on the circumferential surface of the supply roller 15. Carriers of the developer on the sleeve form a chain of ears along a magnetic force line emitted by the magnet roller in the normal line direction. Charged toner particles adhere to the carriers forming the chain of ears, and thereby the magnetic brush is formed. The magnetic brush is moved by rotation of the sleeve in the same direction the sleeve is rotated. The magnet roller includes a plurality of magnetic poles (magnets). Specifically, as illustrated in FIG. 8, a main pole P1 causing the developer to rise like ears in the supply area where the developer is supplied to the electrostatic conveyance roller 13, scoop poles P4 and P5 scooping up the developer onto the sleeve, a conveyance pole 6 conveying the scooped up developer to the supply area, a conveyance pole P2 conveying the developer passed the supply area in the area downstream of the supply area, and a release pole P3 causing the developer to be released from the sleeve are provided. The magnet roller is constructed by a magnet having 6 poles, however, may be constructed by a magnet having 8 or 12 poles.

Figure 31:
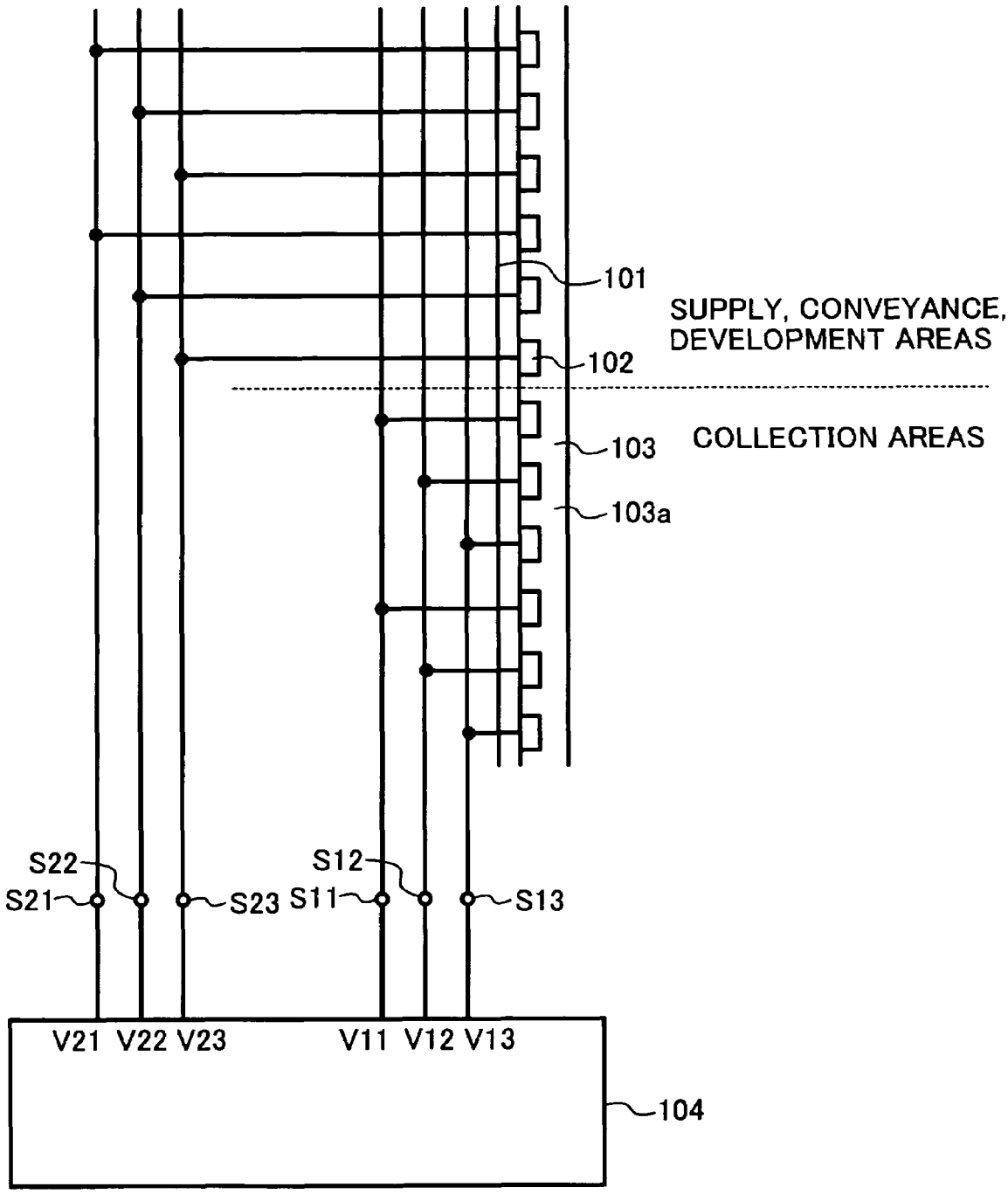
FIG. 31 is a diagram for explaining an electrostatic conveyance roller of the development device of the image forming apparatus of FIG. 28.

The electrostatic conveyance roller 13 includes a plurality of electrodes 102 for generating the phase-shifting electric field. As illustrated in FIG. 31, each electrode 12 is connected with one of contact points S11, S12, S13, S21, S22, and S23 of the development device 66. In the state that the development device 66 has been installed to the main body of the image forming apparatus, respective contact points are connected with a power source 104 of the main body, which provide drive waveforms V11, V12, V13, V21, V22, and V23 to respective contact points.

The electrostatic conveyance roller 13 is divided into a supply area where toner particles are supplied from the supply roller 15, a conveyance area where the supplied toner particles are moved to the vicinity of the image bearing member 61, a development area where the toner particles are caused to adhere to a latent image on the image bearing member 61 to form a toner image, and a collection area where the toner particles passed the development area without contributing to development are collected. The supply area is the area in the vicinity of the main pole P1 of the supply roller 15, the conveyance area is the area between the supply area and the development area, and the development area is the area in the vicinity of the image bearing member 61. The collection area is the area in the vicinity of the conveyance pole P2 of the supply roller 15.

In the supply, conveyance and development areas of the electrostatic conveyance roller 13, the drive waveforms V21, V22, and V23 are applied to respective electrodes 102, and in the collection area, the drive waveforms V11, V12, and V13 are applied to respective electrodes 102. Here, when the bias voltage to the supply roller 15 is −400V, the charge voltage is −140V, and the voltage after exposure is −400V, the drive pulse signals of ±100V (the average value being −100V) are applied to the drive waveforms V21, V22, and V23 to perform supplying of toner particles to the electrostatic conveyance roller 13, moving the toner particles to the development area, and causing the toner particles to adhere to the latent image on the image bearing member 61. Further, the drive pulse signal of ±100V (the average value being −500V) are applied to the drive waveforms V11, V12, and V13 to perform collecting the toner particles passed the development area with the supply roller 15.

The rotation direction of the supply roller 15 is preferably the opposite of the toner conveyance direction of the electrostatic conveyance roller 13 to avoid the collected toner particle from being mixed with the toner particles in the supply area. Thereby, toner particles can be securely supplied to the electrostatic conveyance roller 13 without being influenced by the toner particles collected from the surface of the electrostatic conveyance roller 13.

As described above, in the development device 66, the supply roller 15 supplying toner particles to the electrostatic conveyance roller 13 performs the function of collecting toner particles moving on the surface of the electrostatic conveyance roller 13 passed the development area thereof, so that the development device 66 is made relatively compact.

Figure 32:
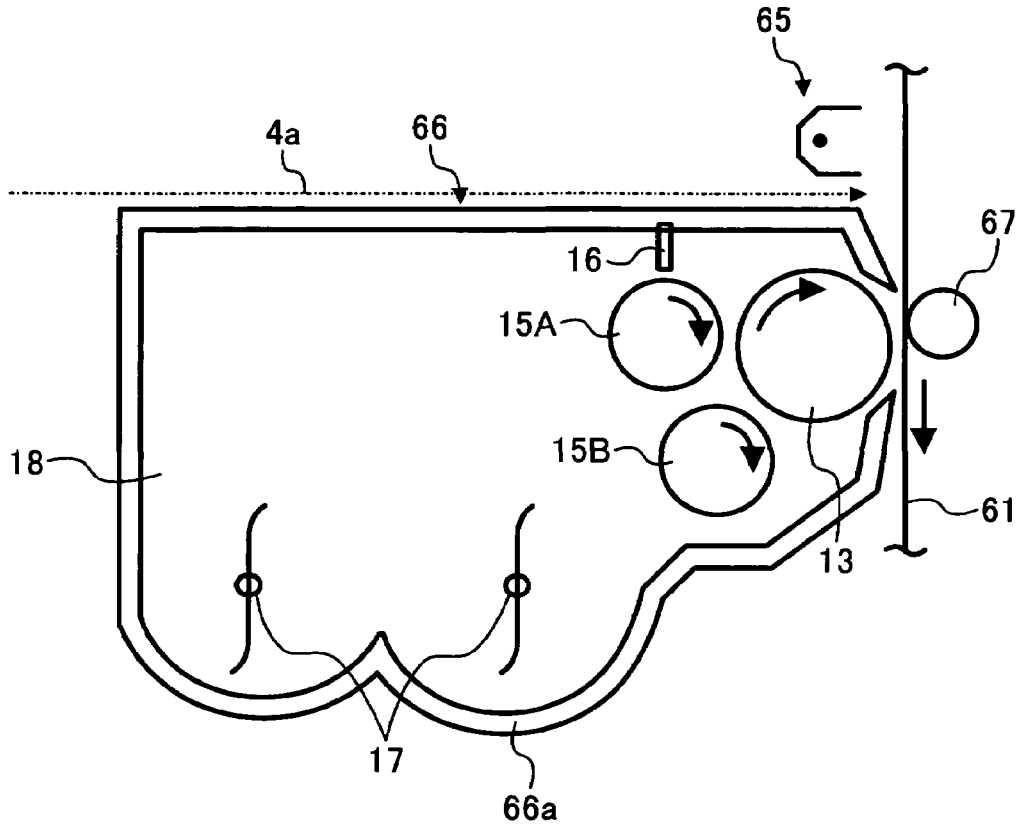
FIG. 32 is a diagram illustrating another example of the development device.

FIG. 32 is a diagram illustrating another example of the development device 66, in which a supply roller 15A and a supply roller 15B are provided. The supply roller 15B collects the toner particles on the electrostatic conveyance roller 13 passed the development area thereof, and the supply roller 15A supplies toner particles to the electrostatic conveyance roller 13. Thereby, the above-described mixture of toner particles is avoided.

Figure 33:
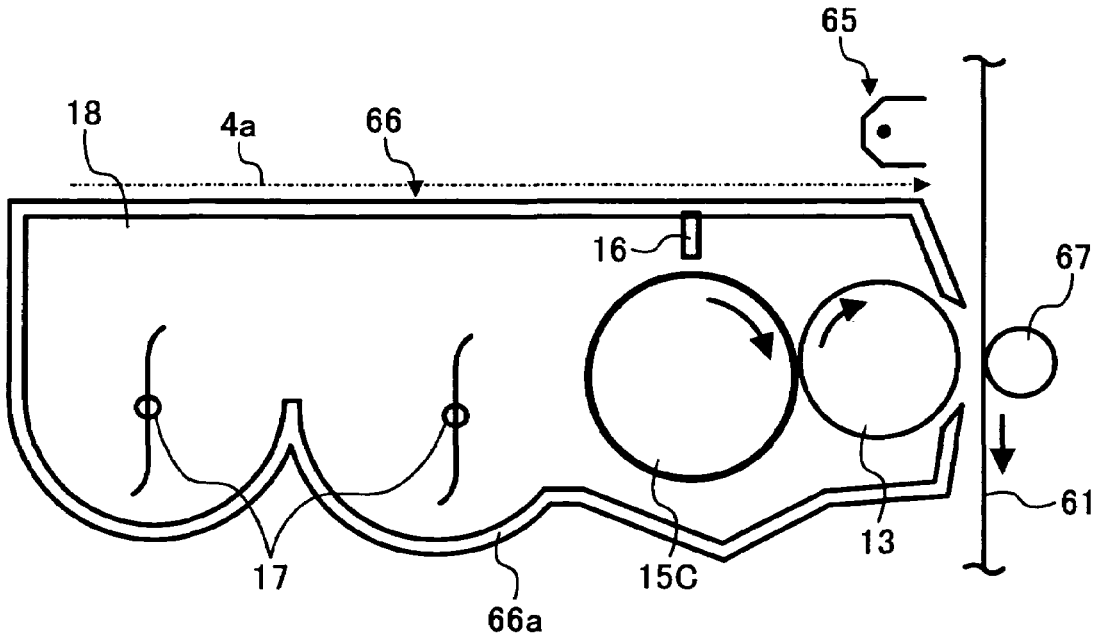
FIG. 33 is a diagram illustrating still another example of the development device, in which single-component developer is used.

FIG. 33 is a diagram illustrating another example of the development device 66, in which a supply roller 15C supplying toner particles to the electrostatic conveyance roller 13 is constituted of a conductive sponge roller so that only the toner particles can be born. By using the conductive roller, single-component developer can be used instead of two-component developer.

Figure 34:
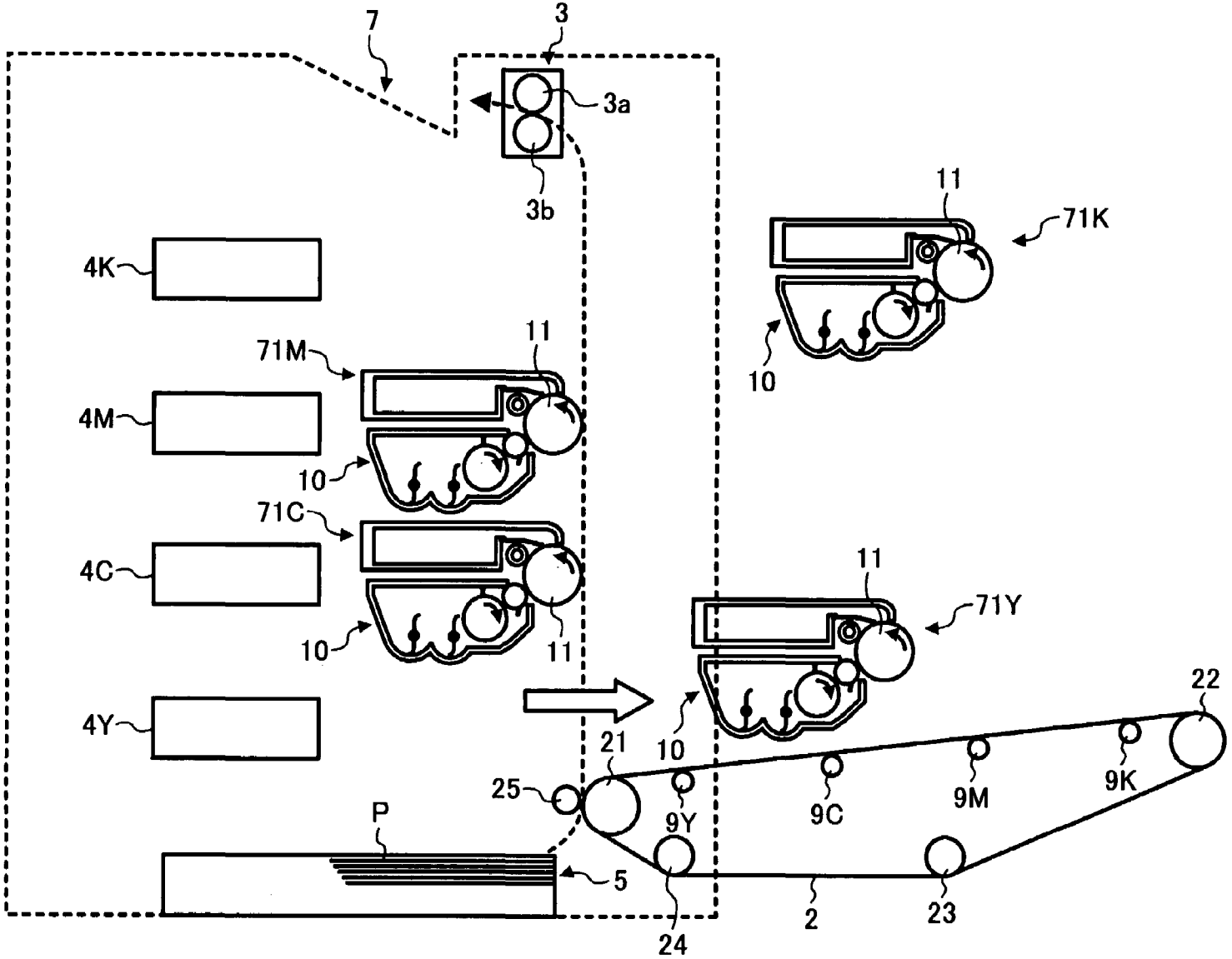
FIG. 34 is a diagram for explaining an image forming apparatus according to another embodiment of the present invention, in which an image formation unit is constructed as a process cartridge.

FIG. 34 is a diagram illustrating an image forming apparatus according to still another embodiment of the present invention, in which a process cartridge including at least a development device is used.

In this embodiment, the image formation unit 1 of the previous embodiment, which has been constructed as a process cartridge by integrating respective elements thereof with each other, is used.

Specifically, a process cartridge 71K, a process cartridge 71M, a process cartridge 71C, and a process cartridge 71Y are realized by integrating respective elements of each of the image formation units 1K, 1M, 1C, and 1Y of the previous embodiment with each other. Each of the process cartridges 71K, 71M, 71C, and 71Y includes at least a development device of the present invention and is configured to be detachable from the main body of the image forming apparatus as an integrated unit.

By retreating a transfer sheet conveyance belt 2 from the main body as illustrated in FIG. 34, each of the process cartridge 71K, the process cartridge 71M, the process cartridge 71C, and the process cartridge 71Y can be detached from the main body for replacement, for example. When forming images, writing light corresponding to image information for black, magenta, cyan, and yellow is illuminated to the process cartridge 71K, the process cartridge 71M, the process cartridge 71C, and the process cartridge 71Y from optical writing devices 4K, 4M, 4C, and 4Y, and toner images of respective colors are formed by respective process cartridges 71.

The present invention can be applied to image forming apparatuses of any type as long as the electrostatic conveyance member can be detached. It is needless to say that the present invention can be applied to a color image forming apparatus using an intermediary transfer belt, a transfer drum, an intermediary transfer drum, etc, and a mono-chrome image forming apparatus.

Numerous additional modifications and variations of the present invention are possible in light of the above-teachings. It is therefore to be understood that within the scope of the claims, the present invention can be practiced otherwise than as specifically described herein.

What is claimed is:

1. A development device developing a latent image on an image bearing member of an image forming apparatus, the development device comprising:

an electrostatic conveyance device having an electrostatic conveyance surface and configured to move toner particles on the electrostatic conveyance surface in a toner conveyance direction by a phase-shifting electric field, the electrostatic conveyance surface having an upstream side end where the phase-shifting electric field starts and a downstream side end where the phase-shifting electric field ends;

a supply device arranged to oppose the upstream side end of the electrostatic conveyance surface of the electrostatic conveyance device to supply the toner particles onto the electrostatic conveyance surface of the electrostatic conveyance device, the toner particles supplied by the supply device onto the electrostatic conveyance surface of the electrostatic conveyance device being moved on the electrostatic conveyance surface by the phase-shifting electric field to a development area of the electrostatic conveyance device opposing the image bearing member for development of the latent image on the latent image bearing member; and a collection device arranged to oppose the downstream side end of the electrostatic conveyance surface of the electrostatic conveyance device and configured to collect the toner particles moved on the electrostatic conveyance surface to a downstream side of the development area of the electrostatic conveyance device in the toner conveyance direction without contributing to the development of the latent image in the development area, wherein the toner particles collected by the collection device are returned to the supply device and wherein the electrostatic conveyance device is circularly formed with the upstream side end and the downstream side end of the electrostatic conveyance surface thereof separated from each other, wherein the electrostatic conveyance device has a second electrostatic conveyance surface between the upstream side end and the downstream side end of the electrostatic conveyance surface thereof and is configured to form the phase-shifting electric field in the second electrostatic conveyance surface in a predetermined timing other than when an image is formed, and wherein the collection device includes a conductive collection member, and a collection electric field is formed between the collection member and the electrostatic conveyance surface of the electrostatic conveyance device and wherein the collection member of the collection device is a conductive plate to which bias voltage of a polarity opposite to that of the toner particles is applied.

2. The development device according to claim 1, wherein the part of the electrostatic conveyance device between the upstream side end and the downstream side end of the electrostatic conveyance surface thereof is formed of insulating material.

3. The development device according to claim 1, wherein the collection member of the collection device is separated from the electrostatic conveyance surface of the electrostatic conveyance device.

4. The development device according to claim 1, wherein the collection member of the collection device is a conductive roller to which bias voltage of a polarity opposite to that of the toner particles is applied.

5. The development device according to claim 1, wherein the collection device includes a collection member configured to contact the toner particles when collecting the toner particles and a separation device configured to separate the toner particles adhered to the collection member from the collection member.

6. The development device according to claim 1, wherein the collection device includes an airflow generation device generating airflow and is configured to collect the toner particles on the electrostatic conveyance surface of the electrostatic conveyance device by a force of the airflow.

7. The development device according to claim 6, wherein the electrostatic conveyance device has a surface where the phase-shifting electric field is not formed between the upstream side end and the downstream side end of the electrostatic conveyance surface and wherein a step is provided such that the surface between the upstream side end and the downstream side end of the electrostatic conveyance surface is lower than the electrostatic conveyance surface.

8. The development device according to claim 1, wherein the electrostatic conveyance surface of the electrostatic conveyance device is formed of non-magnetic material.

9. The development device according to claim 1, wherein the electrostatic conveyance device is configured to move the toner particles at a slower speed in an area of the electrostatic conveyance device where the toner particles are collected by the collection device as compared when the toner particles are moved in other areas of the electrostatic conveyance device.

10. A development device developing a latent image on an image bearing member of an image forming apparatus, the development device comprising:

an electrostatic conveyance device having an electrostatic conveyance surface and configured to move powder on the electrostatic conveyance surface by a phase-shifting electric field to a development area of the electrostatic conveyance device opposing the image bearing member to develop the latent image on the image bearing member;

a supply device configured to supply the powder to the electrostatic conveyance device from a powder accommodation part accommodating the powder; and a collection device arranged below the electrostatic conveyance device and configured to collect the powder on the electrostatic conveyance surface of the electrostatic conveyance device at a location on the surface passed the development area of the electrostatic conveyance device without contributing to development in the development area, the collection device including:

a collection member configured to collect the powder on the electrostatic conveyance surface of the electrostatic conveyance device passed the development area of the electrostatic conveyance member by applying bias voltage to the collection member before the powder passed the development area of the electrostatic conveyance device reaches the development area again, wherein the collection member of the collection device is a magnetic brush roller configured to rotate and to form a brush of magnetic carriers on a circumferential surface thereof and arranged to oppose the electrostatic conveyance surface of the electrostatic conveyance device.

11. A development device developing a latent image on an image bearing member of an image forming apparatus, the development device comprising:

an electrostatic conveyance device having an electrostatic conveyance surface and configured to move powder on the electrostatic conveyance surface by a phase-shifting electric field to a development area of the electrostatic conveyance device opposing the image bearing member to develop the latent image on the image bearing member;

a supply device configured to supply the powder to the electrostatic conveyance device from a powder accommodation part accommodating the powder; and a collection device arranged below the electrostatic conveyance device and configured to collect the powder on the electrostatic conveyance surface of the electrostatic conveyance device at a location on the surface passed the development area of the electrostatic conveyance device without contributing to development in the development area, the collection device including:

a collection member configured to collect the powder on the electrostatic conveyance surface of the electrostatic conveyance device passed the development area of the electrostatic conveyance member by applying bias voltage to the collection member before the powder passed the development area of the electrostatic conveyance device reaches the development area again, wherein the collection device includes a magnet roller arranged at the rear surface side of the electrostatic conveyance surface of the electrostatic conveyance device to form a magnetic brush of magnetic carriers at the electrostatic conveyance surface side of the electrostatic conveyance device.

12. A development device developing a latent image on an image bearing member of an image forming apparatus, the development device comprising:

an electrostatic conveyance device having an electrostatic conveyance surface and configured to move powder on the electrostatic conveyance surface by a phase-shifting electric field to a development area of the electrostatic conveyance device opposing the image bearing member to develop the latent image on the image bearing member;

a supply device configured to supply the powder to the electrostatic conveyance device from a powder accommodation part accommodating the powder; and a collection device arranged below the electrostatic conveyance device and configured to collect the powder on the electrostatic conveyance surface of the electrostatic conveyance device at a location on the surface passed the development area of the electrostatic conveyance device without contributing to development in the development area, the collection device including:

a collection member configured to collect the powder on the electrostatic conveyance surface of the electrostatic conveyance device passed the development area of the electrostatic conveyance member by applying bias voltage to the collection member before the powder passed the development area of the electrostatic conveyance device reaches the development area again, wherein the collection device includes a suction nozzle to suck the powder from the electrostatic conveyance surface of the electrostatic conveyance device.

13. A development device developing a latent image on an image bearing member of an image forming apparatus, the development device comprising:

an electrostatic conveyance device having an electrostatic conveyance surface and configured to move powder on the electrostatic conveyance surface by a phase-shifting electric field to a development area of the electrostatic conveyance device opposing the image bearing member to develop the latent image on the image bearing member;

a supply device configured to supply the powder to the electrostatic conveyance device from a powder accommodation part accommodating the powder, the supply device also configured to collect the powder on the electrostatic conveyance surface of the electrostatic conveyance device at a location on the surface passed the development area of the electrostatic conveyance device without contributing to development in the development area, the supply device including:

a collection member configured to collect the powder on the electrostatic conveyance surface of the electrostatic conveyance device passed the development area of the electrostatic conveyance member by applying bias voltage to the collection member before the powder passed the development area of the electrostatic conveyance device reaches the development area again, wherein the supply device includes a plurality of rollers conveying the powder.

14. The development device according to claim 13, wherein a rotation direction of the supply device is opposite of a progressive direction of the phase-shifting electric field.

15. The development device according to claim 13, wherein single-component developer is used.

16. The development device according to claim 13, wherein two-component developer is used.

* * * * *